US011560792B2

(12) United States Patent
Zhang et al.

(10) Patent No.: US 11,560,792 B2
(45) Date of Patent: Jan. 24, 2023

(54) ASSESSING WELLBORE CHARACTERISTICS USING HIGH FREQUENCY TUBE WAVES

(71) Applicant: ExxonMobil Upstream Research Company, Spring, TX (US)

(72) Inventors: Yibing Zhang, Annandale, NJ (US); Harry W. Deckman, Clinton, NJ (US); Timothy G. Benish, Spring, TX (US); Peter A. Gordon, Yardley, PA (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 17/166,045

(22) Filed: Feb. 3, 2021

(65) Prior Publication Data

US 2021/0301652 A1 Sep. 30, 2021

Related U.S. Application Data

(60) Provisional application No. 63/024,482, filed on May 13, 2020, provisional application No. 63/000,995, filed on Mar. 27, 2020.

(51) Int. Cl.
*E21B 47/16* (2006.01)
*E21B 43/26* (2006.01)

(52) U.S. Cl.
CPC ..... *E21B 47/16* (2013.01); *E21B 43/26* (2013.01)

(58) Field of Classification Search
CPC ..... E21B 47/00; E21B 43/00; E21B 47/107; E21B 49/087; G01V 1/46
See application file for complete search history.

(56) References Cited

U.S. PATENT DOCUMENTS 6,724,687 B1 4/2004 Stephenson et al.
2006/0034152 A1* 2/2006 Korneev ..... G01V 1/50 367/31

(Continued)

FOREIGN PATENT DOCUMENTS

WO 2019089977 A1 5/2019
WO 2019217480 A1 11/2019

OTHER PUBLICATIONS

Dunham, Eric M., Hydraulic fracture conductivity inferred from tube wave reflections, Society of Exploration Geophysicists, 2017, pp. 947-952.

*Primary Examiner* — Zakiya W Bates
(74) *Attorney, Agent, or Firm* — ExxonMobil Upstream Research Company—Law Department

(57) ABSTRACT

A hydrocarbon well includes a wellbore with a surface casing string that couples the wellbore to a wellhead located at the surface and a production casing string that extends through a reservoir within the subsurface. A fluid column is present within the wellbore. The hydrocarbon well also includes a high-frequency tube wave generator that is hydraulically coupled to the wellbore and is configured to generate high-frequency tube waves that propagate within the fluid column. The high-frequency tube waves include a selected waveform containing a specific bandwidth of high-frequency components. The hydrocarbon well further includes a receiver that is hydraulically coupled to the wellbore and is configured to record data corresponding to the generated and reflected high-frequency tube waves propagating within the fluid column, wherein the recorded data relate to characteristics of the wellbore. Moreover, such techniques may also be applied to a pipeline.

20 Claims, 23 Drawing Sheets

(56) References Cited

U.S. PATENT DOCUMENTS

| | | | |
|---|---|---|---|
| 2011/0272147 | A1 | 11/2011 | Beasley et al. |
| 2013/0079935 | A1 | 3/2013 | Kabannik et al. |
| 2019/0055836 | A1 | 2/2019 | Felkl et al. |
| 2019/0136684 | A1 | 5/2019 | Felkl et al. |

* cited by examiner

200

300

400

402

500

502

600

622

700

724

800

802

900

906

910

914

916

1000

1016

1100

1122

1200

1300

ASSESSING WELLBORE CHARACTERISTICS USING HIGH FREQUENCY TUBE WAVES

CROSS-REFERENCE TO RELATED APPLICATIONS

This application claims the benefit of U.S. Provisional Application No. 63/000,995, filed Mar. 27, 2020, and U.S. Provisional Application No. 63/024,482, filed May 13, 2020, the disclosures of which are herein incorporated by reference in their entireties.

FIELD OF THE INVENTION

The techniques described herein relate to the field of hydrocarbon well completions and hydraulic fracturing operations. More particularly, the techniques described herein relate to generating high-frequency tube waves that can be used to collect data relating to characteristics of a wellbore, such as the numbers, sizes, and locations of fractures corresponding to perforation clusters within different stages of the wellbore.

BACKGROUND OF THE INVENTION

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

In the drilling of hydrocarbon wells, a wellbore is formed within a formation using a drill bit that is urged downwardly at the lower end of a drill string until it reaches a predetermined bottomhole location. The drill string and bit are then removed, and the wellbore is lined with steel tubulars, referred to as casing strings. An annulus is thus formed between the casing strings and the surrounding subsurface formation. A cementing operation is typically conducted to fill the annulus with columns of cement. The combination of the casing strings and the cement strengthens the wellbore and facilitates the zonal isolation of the surrounding subsurface formation.

It is common to place several casing strings having progressively-smaller outer diameters into the wellbore. The first casing string may be referred to as the "surface casing sting." The surface casing string serves to isolate and protect the shallower, freshwater-bearing aquifers from contamination by any other wellbore fluids. Accordingly, this casing string is almost always cemented entirely back to the surface.

A process of drilling and then cementing progressively-smaller casing strings is repeated several times below the surface casing string until the hydrocarbon well has reached total depth. The final casing string, referred to as the "production casing string," extends through a hydrocarbon-bearing interval within the formation, referred to as a "reservoir." In some instances, the production casing string is a liner, that is, a casing string that is not tied back to the surface. The production casing string is also typically cemented into place. In some completions, the production casing string has swell packers or external casing packers spaced across selected productive intervals. This creates compartments between the packers for isolation of stages and specific stimulation treatments. In this instance, the annulus may simply be packed with subsurface formation sand.

As part of the completion process, the production casing string is perforated at a desired level. This means that lateral holes are shot through the production casing string and the cement column surrounding the production casing string using a perforating gun. In operation, the perforating gun typically forms one perforation cluster by shooting 12 to 18 perforations at one time, over a 1 to 3 foot region, with each perforation being approximately 0.3 to 0.5 inches in diameter. The perforating gun is then typically moved uphole 10 to 100 feet, and a second perforating gun is used to form a second perforation cluster. This process of forming perforation clusters is repeated another 1 to 18 times to create a total of 3 to 20 perforation clusters within each stage of the hydrocarbon well. The resulting clusters of perforations allow hydrocarbon fluids from the surrounding reservoir to flow into the hydrocarbon well.

After the perforation process is complete, the reservoir is typically fractured at the corresponding stage to increase the reservoir's productivity. Hydraulic fracturing consists of injecting a pad of fracturing fluid, such as slickwater, into a reservoir at such high pressures and rates that the reservoir rock cracks and forms a cluster of fractures. In operation, the injection pressure of the fracturing fluid exceeds the hydraulic pressure in the subsurface, and often even exceeds the lithostatic pressure in the formation.

Hydraulic fracturing is used most extensively for increasing the productivity of "unconventional," or "tight," reservoirs, which are reservoirs with very low permeability that typically do not produce economically without hydraulic fracturing. Examples of unconventional reservoirs include tight sandstone reservoirs, tight carbonate reservoirs, shale gas reservoirs, coal bed methane reservoirs, tight oil reservoirs, and/or tight limestone reservoirs. During the hydraulic fracturing of such reservoirs, the injection rate of the fracturing fluid is typically increased until it reaches a maximum injection rate of around 20-150 barrels per minute (bbl/min). In operation, approximately 5,000 to 15,000 barrels of fracturing fluid may be injected for each stage of the hydrocarbon well.

Next, a pad of fracturing fluid mixed with a proppant material, such as sand, crushed granite, ceramic beads, or other granular materials, is pumped into the hydrocarbon well. The volume of proppant material is usually increased as fracturing progresses, with the ultimate volume percent of the proppant material in the fracturing fluid reaching around 10 vol. %. The proppant material serves to hold the fractures open after the hydraulic pressures are released. Ideally, the resulting fractures grow to be hundreds of feet long. In the case of unconventional reservoirs, the combination of fractures and injected proppant substantially increases the flow capacity of the treated reservoir.

In order to further stimulate the reservoir and to clean the near-wellbore regions downhole, an operator may choose to acidize the reservoir. This is done by injecting an acid solution down the wellbore and through the perforations. The use of an acidizing solution is particularly beneficial when the reservoir includes tight carbonate rock. In operation, the completion company injects a concentrated formic acid or other acidic composition into the wellbore and directs the fluid into selected stages of interest. The acid helps to dissolve carbonate material, thereby opening up porous channels through which hydrocarbon fluids may flow into the hydrocarbon well. In addition, the acid helps to dissolve drilling mud that may have invaded the reservoir.

Application of hydraulic fracturing and acid stimulation as described above is a routine part of petroleum industry operations as applied to individual reservoirs. Such reservoirs may represent hundreds of feet of gross, vertical thickness of subterranean formation. More recently, hydrocarbon wells are being completed through reservoirs horizontally, with the horizontal (or "lateral") sections often extending greater than 1,000 feet, in which case the hydrocarbon well may be referred to as an "extended-reach lateral well," or, in some cases, greater than 10,000 feet, in which case the hydrocarbon well may be referred to as an ultra-extended-reach lateral well.

When there are multiple-layered or very thick reservoirs to be hydraulically fractured, or where an extended-reach or ultra-extended-reach lateral well is being completed, then more complex treatment techniques are required to obtain treatment of the entire target area. Therefore, the operating company must isolate various stages to ensure that each separate stage is not only perforated, but also adequately fractured and treated. In this way, the operator is sure that fracturing fluid and stimulant are being injected through each perforation cluster and into each stage of interest to effectively increase the flow capacity at each desired depth.

Treatment of a stage of interest requires isolation from all stages that have already been treated. This, in turn, involves the use of so-called diversion methods, in which injected fracturing fluid is directed towards one selected stage of interest while being diverted from other stages. In many cases, frac plugs are set between stages and are used to prevent injected fluid from entering stages that have already been fractured and propped.

This hydraulic fracturing process is repeated for every stage in the hydrocarbon well. In the case of wells including lateral sections, the first stage is typically located near the end (or "toe") of the lateral section, and the last stage is typically located near the beginning (or "heel") of the lateral section. For extended-reach lateral wells, there will typically be around 20-50 individual stages. Moreover, some ultra-extended-reach lateral wells may include more than 100 stages.

After the hydraulic fracturing process is complete, the frac plugs (and/or other diversion materials) may be drilled out of the hydrocarbon well. The hydrocarbon well may then be put into production, meaning that it may be used to recover hydrocarbon fluids from the reservoir. In operation, the pressure differential between the reservoir and the hydrocarbon well is typically used to force hydrocarbon fluids to flow through the fractures in the reservoir and into the production casing string via the corresponding perforation clusters. The hydrocarbon fluids then flow up the hydrocarbon well to the surface.

In operation, the success of the hydraulic fracturing process has a direct impact on the amount of hydrocarbon fluids that may be recovered from the reservoir. Specifically, the numbers, sizes, and locations of the fractures corresponding to the perforation clusters within each stage of the hydrocarbon well directly impact the amount of hydrocarbon fluids that are able to mobilize and flow into the hydrocarbon well. Moreover, it has been estimated that only a fraction of the stages in a multi-stage well typically contribute to the ultimate production of hydrocarbon fluids from the reservoir. Accordingly, accurate fracture characterization is essential for enabling optimized well planning and efficient stimulation. However, to date, reliable and accurate fracture characterization remains elusive.

One common fracture diagnostic technique involves generating tube waves associated with water hammer signals at the end of a hydraulic fracturing process for a particular stage. Specifically, pumps being used to inject fracturing fluid into the stage at a high flow rate of around 90 bbl/min are gradually shut down over a 10-30 second time interval. This gradual change in well pressure generates a tube wave within the wellbore. However, tube waves generated in this manner are limited in bandwidth, with typical frequency ranges of only a few Hertz (Hz). Moreover, data collected from tubes waves with such limited bandwidths and low frequencies exhibit high reflectivity at impedance boundaries between fractures and the wellbore, as well as limited spatial resolution, and, thus, do not provide highly accurate information regarding the fractures within the surrounding reservoir.

Another fracture diagnostic technique is provided by U.S. Patent Application Publication No. 2019/0055836 A1, entitled "Method for Fracture Activity Monitoring and Pressure Wave Resonance Analysis for Estimating Geophysical Parameters of Hydraulic Fractures Using Fracture Waves." The technique described therein involves generating a tube wave within a hydrocarbon well using a pressure source, measuring the resulting pressure signal for a certain period of time, and then determining at least one physical parameter of the hydrocarbon well using the measured pressure signal. The pressure source may be an active source, such as a water hammer or fracture treatment pump, or a continuous/passive source, such as general fluid pumping energy or microseismic events. However, such pressure sources generally produce limited-bandwidth, low-frequency pressure pulses. Thus, this technique suffers from the same shortfalls discussed above, namely, the inability to provide detailed information regarding the fractures within the reservoir.

U.S. Patent Application Publication No. 2013/0079935 A1, entitled "Method of Real Time Diagnostic of Fracture Operations with Combination of Tube Waves and Microseismic Monitoring," provides another fracture diagnostic technique that involves generating tube waves in a wellbore, recording the tube wave reflections from the fractures in the wellbore, and analyzing the recorded data to determine fracture characteristics within the wellbore. However, the technique described therein explicitly relates to low-frequency tube waves and, thus, is similarly limited in terms of reflectivity and spatial resolution.

Another fracture diagnostic technique is provided by U.S. Patent Application Publication No. 2019/0136684 A1, entitled "Method for Evaluating and Monitoring Formation Fracture Treatment Closure Rates and Pressures Using Fluid Pressure Waves." The fracture diagnostic technique described therein involves using an active acoustic source and a pressure gauge at the wellhead to probe subsurface fracture properties, such as the fracture conductivity. This technique utilizes pressure waves with low frequencies, i.e., below 10 Hz, and long wavelengths, i.e., around 150 meters. The use of pressure waves with such low frequencies and long wavelengths results in a low spatial resolution and, thus, an inability to differentiate fractures that are less than around 100 meters apart. As a result, this technique also fails to provide detailed information regarding the individual fractures corresponding to the perforation clusters in each stage within the reservoir.

U.S. Pat. No. 6,724,687 B1, entitled "Characterizing Oil, Gas, or Geothermal Wells, Including Fractures Thereof," provides yet another fracture diagnostic technique that involves using an excitation event within a wellbore to create a responsive signal having higher-frequency components superposed on lower-frequency components, wherein the lower-frequency components are resonant responsive to a length of the wellbore, and the higher-frequency components provide information about one or more characteristics of the fracture extending from the wellbore. This technique includes using rapidly-closing valves to create the responsive signal, and using a high-frequency-response pressure sensor to detect the responsive signal either downhole or at the surface. For this technique, it is assumed that the higher-frequency components will excite the fracture at its natural, or resonant, frequency, and can be detected on top of the lower-frequency components to characterize the fracture properties. This assumption provides a method to characterize one fracture or cluster with a limited size, and the provided example uses one equivalent fracture or cluster, not separated fractures. This technique cannot be used to detect a long fracture because no resonant signal would be generated within a long fracture due to the strong pressure wave attention inside the fracture. Moreover, this technique does not allow fractures to be differentiated from other structures, such as casing joints and fracture entrances from the wellbore, that may form acoustic resonators and generate high-frequency resonance in the wellbore.

Other existing fracture diagnostic techniques, such as microseismic event detection, distributed temperature and acoustic sensing, time-lapsed resistivity mapping, and the use of tagged proppants, rely on indirect measurements whose interpretation is subject to uncertainties. Moreover, the high cost of such techniques often precludes their routine application. Therefore, there exists a need for accurate, reliable, and cost-effective fracture diagnostic techniques, particularly for detecting multiple fractures per stage in multi-stage, unconventional wells.

SUMMARY OF THE INVENTION

An embodiment described herein provides a hydrocarbon well. The hydrocarbon well includes a wellbore with a surface casing string that couples the wellbore to a wellhead located at a surface and a production casing string that extends through a reservoir within a subsurface. A fluid column is present within the wellbore. The hydrocarbon well also includes a high-frequency tube wave generator that is hydraulically coupled to the wellbore and is configured to generate high-frequency tube waves that propagate within the fluid column. The high-frequency tube waves include a selected waveform containing a specific bandwidth of high-frequency components. The hydrocarbon well further includes a receiver that is hydraulically coupled to the wellbore and is configured to record data corresponding to the generated high-frequency tube waves and reflected high-frequency tube waves propagating within the fluid column. The recorded data relate to characteristics of the wellbore.

Another embodiment described herein provides a method for collecting data relating to characteristics of a wellbore. The method includes generating high-frequency tube waves including a selected waveform containing a specific bandwidth of high-frequency components using a high-frequency tube wave generator that is hydraulically coupled to a wellbore, wherein the high-frequency tube waves propagate within a fluid column within the wellbore that is defined by a surface casing string that couples the wellbore to a wellhead located at a surface and a production casing string that extends through a reservoir within a subsurface. The method also includes allowing the high-frequency tube waves to interact with acoustic impedance boundaries that act as reflectors within the wellbore, creating reflected high-frequency tube waves that propagate within the fluid column. The method further includes recording data corresponding to the generated high-frequency tube waves and the reflected high-frequency tube waves using a receiver that is hydraulically coupled to the wellbore, wherein the recorded data relate to characteristics of the reflectors within the wellbore.

Another embodiment described herein provides a system for collecting data relating to characteristics of a wellbore. The system includes a high-frequency tube wave generator that is hydraulically coupled to a wellbore and is configured to generate high-frequency tube waves including a selected waveform containing a specific bandwidth of high-frequency components, wherein the high-frequency tube waves propagate within a fluid column within the wellbore and interact with reflectors within the wellbore, creating reflected high-frequency tube waves that propagate within the fluid column, and wherein the fluid column is defined by a surface casing string that couples the wellbore to a wellhead and a production casing string that extends through a reservoir. The system also includes a receiver that is hydraulically coupled to the wellbore and is configured to record data corresponding to the generated high-frequency tube waves and the reflected high-frequency tube waves, wherein the recorded data relate to characteristics of the reflectors within the wellbore.

Another embodiment described herein provides a method for collecting data relating to characteristics of a pipeline. The method includes generating high-frequency tube waves including a selected waveform containing a specific bandwidth of high-frequency components using a high-frequency tube wave generator that is hydraulically coupled to a pipeline, wherein the high-frequency tube waves propagate within a fluid column within the pipeline. The method also includes allowing the high-frequency tube waves to interact with acoustic impedance boundaries that act as reflectors within the pipeline, creating reflected high-frequency tube waves that propagate within the fluid column. The method further includes recording data corresponding to the high-frequency tube waves and the reflected high-frequency tube waves using a receiver that is hydraulically coupled to the pipeline, wherein the recorded data relate to characteristics of the reflectors within the pipeline.

BRIEF DESCRIPTION OF THE DRAWINGS

Advantages of the present techniques may become apparent upon reviewing the following detailed description and drawings of non-limiting examples in which.

Figure 1A:
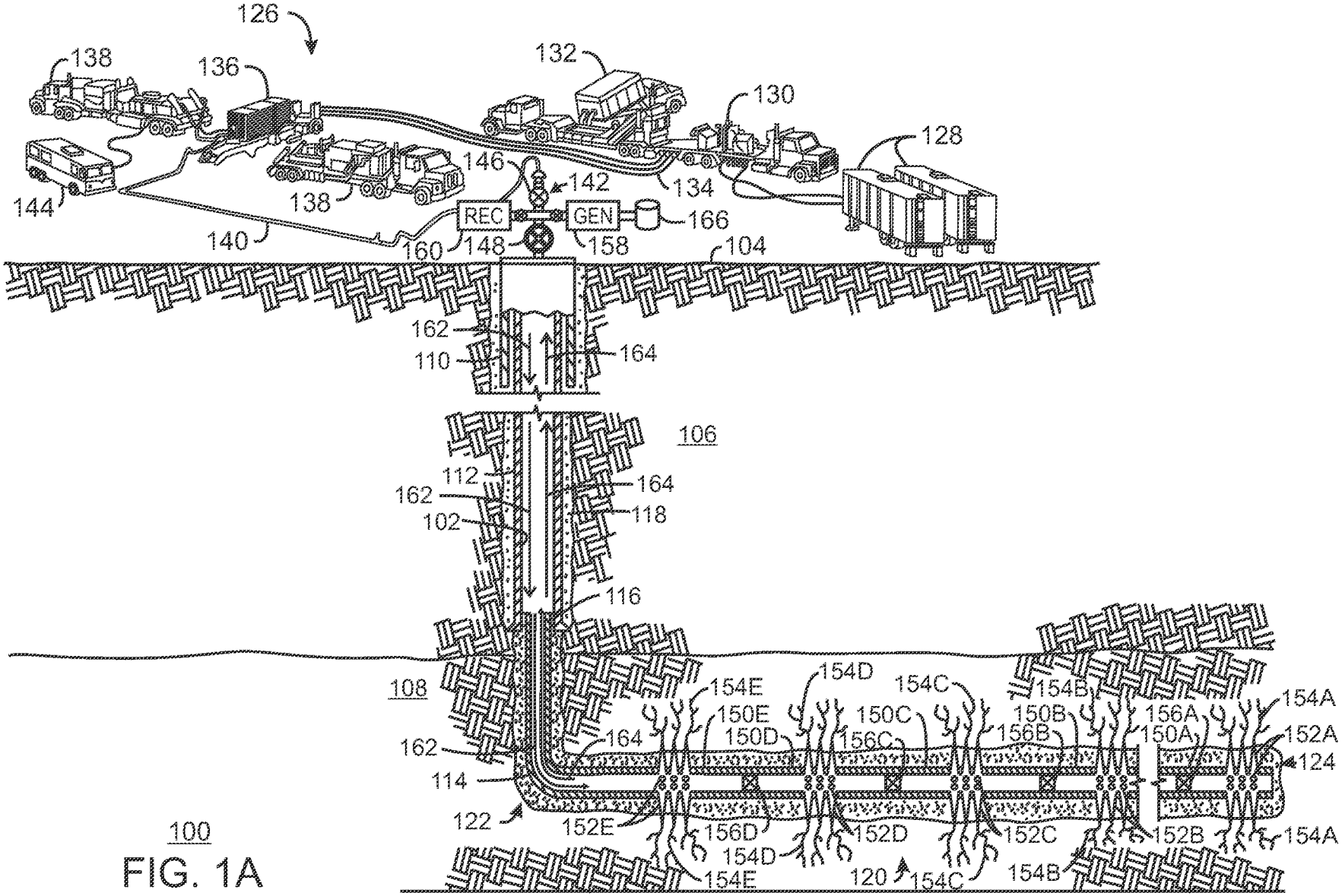
FIG. 1A is a schematic view of an exemplary hydrocarbon well including fracture diagnostic equipment that may be used in conjunction with a hydraulic fracturing process.

It should be noted that the figures are merely examples of the present techniques, and are not intended to impose limitations on the scope of the present techniques. Further, the figures are generally not drawn to scale, but are drafted for purposes of convenience and clarity in illustrating various aspects of the techniques.

DETAILED DESCRIPTION OF THE INVENTION

In the following detailed description section, the specific examples of the present techniques are described in connection with preferred embodiments. However, to the extent that the following description is specific to a particular embodiment or a particular use of the present techniques, this is intended to be for example purposes only and simply provides a description of the embodiments. Accordingly, the techniques are not limited to the specific embodiments described below, but rather, include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the terms "a" and "an" mean one or more when applied to any embodiment described herein. The use of "a" and "an" does not limit the meaning to a single feature unless such a limit is specifically stated.

The term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "including," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

The phrase "at least one," in reference to a list of one or more entities, should be understood to mean at least one entity selected from any one or more of the entities in the list of entities, but not necessarily including at least one of each and every entity specifically listed within the list of entities, and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently, "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, the term "bleed off" refers to the process of relieving pressure from a higher-pressure source, such as a wellbore, to open air or to a lower-pressure vessel, such as a storage container or tank.

As used herein, the term "configured" means that the element, component, or other subject matter is designed and/or intended to perform a given function. Thus, the use of the term "configured" should not be construed to mean that a given element, component, or other subject matter is simply "capable of" performing a given function but that the element, component, and/or other subject matter is specifically selected, created, implemented, utilized, and/or designed for the purpose of performing the function.

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "fluid" refers to gases, liquids, and combinations of gases and liquids, as well as to combinations of gases and solids, and combinations of liquids and solids.

"Formation" refers to a subsurface region including an aggregation of subsurface sedimentary, metamorphic and/or igneous matter, whether consolidated or unconsolidated, and other subsurface matter, whether in a solid, semi-solid, liquid and/or gaseous state, related to the geological development of the subsurface region. A formation can be a body of geologic strata of predominantly one type of rock or a combination of types of rock, or a fraction of strata having substantially common sets of characteristics. A formation can contain one or more hydrocarbon-bearing intervals, generally referred to as "reservoirs." Note that the terms "formation," "reservoir," and "interval" may be used interchangeably, but may generally be used to denote progressively smaller subsurface regions, stages, or volumes. More specifically, a "formation" may generally be the largest subsurface region, while a "reservoir" may generally be a hydrocarbon-bearing stage or interval within the geologic formation that includes a relatively high percentage of oil and gas. Moreover, an "interval" may generally be a subregion or portion of a reservoir. In some cases, a hydrocarbon-bearing stage, or reservoir, may be separated from other hydrocarbon-bearing stages by stages of lower permeability, such as mudstones, shales, or shale-like (i.e., highly-compacted) sands.

The use of the noun "fracture" refers to a crack or surface of breakage induced by an applied pressure within a subsurface formation. Moreover, the use of the noun "fracture cluster" refers to a group of closely-spaced fractures corresponding to a particular perforation cluster within a particular stage of a multi-stage hydrocarbon well.

The use of the verb "fracture" means to perform a stimulation treatment, such as a hydraulic fracturing treatment, which is routine for hydrocarbon wells in low-permeability reservoirs. Specially-engineered fracturing fluids are pumped at high pressures and rates into the reservoir interval to be treated, causing fractures to open. The wings of the fractures extend away from the wellbore in opposing directions according to the natural stresses within the formation. Moreover, multiple fractures that form patterns may be referred to as "fracture networks." The characteristics of different fractures and fracture networks have a significant impact on a reservoir's storage capability, measured in terms of porosity, and the flow rate of hydrocarbon fluids from the reservoir, measured in the terms of porosity, permeability, and transmissibility.

The term "fracturing fluid" refers to a fluid injected into a hydrocarbon well as part of a stimulation operation. A commonly-used fracturing fluid is "slickwater." Slickwater is mostly water with a small amount, i.e., around 1%, of friction reducers and other viscous fluids (usually shear thinning, non-Newtonian gels or emulsions). The friction reducers and viscous fluids allow for a faster pumping rate into a reservoir, leading to an increase in the numbers and sizes of the fractures formed.

The term "hydraulic fracturing" (or "fracing") refers to a process for creating fractures that extend from a wellbore into a reservoir, so as to stimulate the flow of hydrocarbon fluids from the reservoir into the wellbore. A fracturing fluid is generally injected into the reservoir with sufficient pressure to create and extend multiple fractures within the reservoir, and a proppant material is used to "prop" or hold open the fractures after the hydraulic pressure used to generate the fractures has been released.

A "hydrocarbon" is an organic compound that primarily includes the elements hydrogen and carbon, although nitrogen, sulfur, oxygen, metals, or any number of other elements may be present in small amounts. As used herein, the term "hydrocarbon" generally refers to components found in natural gas, oil, or chemical processing facilities. Moreover, the term "hydrocarbon" may refer to components found in raw natural gas, such as $CH_4$, $C_2H_6$, $C_3$ isomers, $C_4$ isomers, benzene, and the like.

The term "pressure" refers to a force acting on a unit area. Pressure is usually shown as pounds per square inch (psi).

According to embodiments described herein, the terms "pressure receiver," "pressure transducer," and "pressure gauge" are used, sometimes interchangeably, to refer to devices used to measure pressure.

As used herein, the term "proppant" or "proppant material" refers to particles that are mixed with fracturing fluid to hold open fractures that are formed within a near-wellbore region of a reservoir using a hydraulic fracturing process. The size, shape, strength, and density of the proppant material have a significant impact on the hydraulic fracturing process. Currently, commercial proppant materials include natural proppants, such as natural sands, resin-coated natural sands, shell fragments, and the like, and artificial proppants, such as sintered bauxite and ceramics, resin-coated ceramics, lightweight proppants, ultra-lightweight proppants, and the like.

As used herein, the term "surface" refers to the uppermost land surface of a land well, or the mud line of an offshore well, while the term "subsurface" (or "subterranean") generally refers to a geologic strata occurring below the earth's surface. Moreover, as used herein, "surface" and "subsurface" are relative terms. The fact that a particular piece of equipment is described as being on the surface does not necessarily mean it must be physically above the surface of the earth but, rather, describes only the relative placement of the surface and subsurface pieces of equipment. In that sense, the term "surface" may generally refer to any equipment that is located above the casing strings and other equipment that is located inside the wellbore. Moreover, according to embodiments described herein, the terms "downhole" and "subsurface" are sometimes used interchangeably, although the term "downhole" is generally used to refer specifically to the inside of the wellbore.

As used herein, the term "tube wave" refers to a pressure wave that travels through a wellbore one-dimensionally parallel to the direction of the wellbore. The tube wave is initiated via a pressure fluctuation within the wellbore, and propagates through the wellbore via a fluid column within the wellbore that acts as an acoustic waveguide for the tube wave. The properties of the tube wave correlate to dynamic pressures at different points within the wellbore. Moreover, different obstacles in the wellbore, such as pipe sections with different diameters, frac plugs, perforations, and fractures, are characterized by different "acoustic impedances" and serve as "reflectors" for the tube wave. Specifically, the acoustic impedance (Z) of a particular material is a product of the material's density (p) and acoustic velocity (V), and acoustic impedance variations between two materials have an effect on the acoustic transmission and reflection of the tube wave at the boundary of the two materials.

Like other types of waves, tube waves can be differentiated by their frequency, amplitude, wavelength, and speed of propagation. The wavelength of a particular wave is defined as the wave's speed of propagation divided by its frequency, where wavelength is measured in meters (m), speed of propagation is measured in meters per second (m/s), and frequency is measured in Hertz (Hz). Moreover, the amplitude of a particular wave is the wave's maximum displacement from its rest position. When a wave is represented graphically, the wavelength may be identified by determining the distance between the successive peaks of the wave, and the amplitude may be identified by determining the distance between the wave's center line and its peak.

The terms "well" and "wellbore" refer to holes drilled vertically, at least in part, and may also refer to holes drilled with deviated, highly deviated, and/or lateral sections. The term also includes the wellhead equipment, surface casing string, intermediate casing string(s), production casing string, and the like, typically associated with hydrocarbon wells.

The term "valve coefficient" (Cv) refers to a number that represents the capability of a valve to flow a fluid. The larger the valve coefficient, the larger the flow at a given pressure differential.

Embodiments described herein provide a cost-effective, minimally-intrusive wellbore diagnostic technique that may be used to optimize well planning. In particular, embodiments described herein provide a fracture diagnostic technique that enables fracture geometry to be characterized at a cluster level in each stage of a multi-stage hydrocarbon well.

According to embodiments described herein, high-frequency tube waves are generated using a high-frequency tube wave generator that is hydraulically coupled to a wellbore. The high-frequency tube wave generator exhibits a high level of controllability and repeatability that enables the generation of tube waves including a selected waveform containing a specific bandwidth of high-frequency components. The generated high-frequency tube waves then propagate through a fluid column within the wellbore and interact with acoustic impedance boundaries, which may be generally referred to as "reflectors," within the wellbore, resulting in the generation of reflected high-frequency tube waves that propagate back up the fluid column toward the wellhead. Data relating to the generated high-frequency tube waves and the reflected high-frequency tube waves are recorded using a receiver, such as a high-frequency, high-sensitivity pressure receiver, that is hydraulically coupled to the wellbore. The recorded data relate to characteristics of the reflectors within the wellbore. Specifically, in various embodiments, the recorded data relate to fractures characteristics within a particular stage of the wellbore. For example, the recorded data may relate to the number of perforation clusters for which fractures have formed within the particular stage, the sizes of the fractures corresponding to the perforation clusters for which fractures have formed, the locations of the perforation clusters for which fractures have formed, and/or the number of perforation clusters that have been stimulated to at least a threshold level as measured by the characteristics of the fractures corresponding to the perforation clusters within the particular stage. Such data may then be used to enable optimized well planning and efficient stimulation of the wellbore.

Exemplary Hydrocarbon Wells Utilizing Fracture Diagnostic Equipment in Conjunction with a Hydraulic Fracturing Process FIG. 1A is a schematic view of an exemplary hydrocarbon well 100 including fracture diagnostic equipment that may be used in conjunction with a hydraulic fracturing process. The hydrocarbon well 100 defines a wellbore 102 that extends from a surface 104 into a formation 106 within the earth's subsurface. The formation 106 may include several subsurface intervals, such as a hydrocarbon-bearing interval that is referred to herein as a reservoir 108. In some embodiments, the reservoir 108 is an unconventional, tight reservoir, meaning that it has regions of low permeability. For example, the reservoir 108 may include tight sandstone, tight carbonate, shale gas, coal bed methane, tight oil, and/or tight limestone.

The hydrocarbon well 100 is completed by setting a series of tubulars into the formation 106. These tubulars include several strings of casing, such as a surface casing string 110, an intermediate casing string 112, and a production casing string 114, which is sometimes referred to as a "production liner." In some embodiments, additional intermediate casing strings (not shown) are also included to provide support for the walls of the hydrocarbon well 100. According to the embodiment shown in FIG. 1A, the surface casing string 110 and the intermediate casing string 112 are hung from the surface 104, while the production casing string 114 is hung from the bottom of the intermediate casing string 112 using a liner hanger 116.

The surface casing string 110 and the intermediate casing string 112 are set in place using cement 118. The cement 118 isolates the intervals of the formation 106 from the hydrocarbon well 100 and each other. The production casing string 114 may also be set in place using cement 118, as shown in FIG. 1A. Alternatively, the hydrocarbon well 100 may be set as an open-hole completion, meaning that the production casing string 114 is not set in place using cement.

The exemplary hydrocarbon well 100 shown in FIG. 1A is completed horizontally (or laterally). A lateral section is shown at 120. The lateral section 120 has a heel 122 and a toe 124 that extends through the reservoir 108 within the formation 106. In some embodiments, the distance between the heel 122 and the toe 124 is over 1,000 feet, in which case the hydrocarbon well 100 may be referred to as an extended-reach lateral well. In other embodiments, the distance between the heel 122 and the toe 124 is over 10,000 feet, in which case the hydrocarbon well 100 may be referred to as an ultra-extended-reach lateral well.

In various embodiments, because the reservoir 108 is an unconventional, tight reservoir, a hydraulic fracturing process may be performed to allow hydrocarbon fluids to be economically produced from the hydrocarbon well 100. As shown in FIG. 1A, the hydraulic fracturing process may utilize an extensive amount of equipment at a well site 126 located on the surface 104. The equipment may include fluid storage tanks 128 to hold fracturing fluid, such as slickwater, and blenders 130 to blend the fracturing fluid with other materials, such as proppant 132 and other chemical additives, forming a low-pressure slurry. The low-pressure slurry 134 may be run through a treater manifold 136, which may use pumps 138 to adjust flow rates, pressures, and the like, creating a high-pressure slurry 140, which can be pumped down the hydrocarbon well 100 via a wellhead 142 and used to fracture the rocks in the reservoir 108. Moreover, a mobile command center 144 may be used to control the hydraulic fracturing process, as well as the fracture diagnostic technique described herein.

The wellhead 142 may include any arrangement of pipes and valves for controlling the hydrocarbon well 100. In some embodiments, the wellhead 142 is a so-called "Christmas tree." A Christmas tree is typically used when the subsurface formation 106 has enough in-situ pressure to drive hydrocarbon fluids from the reservoir 108, up the wellbore 102, and to the surface 104. The illustrative wellhead 142 includes a top valve 146 and a bottom valve 148. In some contexts, these valves are referred to as "master valves." Moreover, in various embodiments, the wellhead 142 also couples the hydrocarbon well 100 to other equipment, such as equipment for running a wireline (not shown) into the hydrocarbon well 100. In some embodiments, the equipment for running the wireline into the hydrocarbon well 100 includes a lubricator (not shown), which may extend as much as 75 feet above the wellhead 142. In this respect, the lubricator must be of a length greater than the length of a bottomhole assembly (BHA) (not shown) attached to the wireline to ensure that the BHA may be safely deployed into the hydrocarbon well 100 and then removed from the hydrocarbon well 100 under pressure.

While there are several different methods for hydraulically fracturing a reservoir, a hydraulic fracturing process referred to as a "plug-and-perforation process" is described with respect to FIG. 1A. During the plug-and-perforation process, a specialized BHA, referred to as a "plug-and-perf assembly," (not shown) is run into the hydrocarbon well 100 via the wireline connected to the wellhead 142. The wireline provides electrical signals to the surface 104 for depth control. In addition, the wireline provides electrical signals to perforating guns (not shown) included within the plug-and-perf assembly. The electrical signals may allow the operator within the mobile command center 144 to cause the charges within the perforating gun to fire, or detonate, at a desired stage or depth within the hydrocarbon well 100.

In operation, the perforating gun is run into a first stage 150A of the hydrocarbon well 100 located near the toe 124 of the lateral section 120. The perforating gun is then detonated to create a first set of perforation clusters 152A through the production casing string 114 and the surrounding cement 118. In operation, the perforating gun typically forms one perforation cluster by shooting 12 to 18 perforations at one time, over a 1 to 3 foot region, with each perforation being approximately 0.3 to 0.5 inches in diameter. The perforating gun is then typically moved uphole 10 to 100 feet, and a second perforating gun is used to form a second perforation cluster. This process of forming perforation clusters is repeated another 1 to 18 times to create several perforation clusters within a single stage. Therefore, while only one perforation cluster is shown for each stage 150A-E in FIG. 1A, each stage within the hydrocarbon well 100 may include a total of around 3 to 20 perforation clusters, with each perforation cluster being spaced around 10 to 100 feet apart.

The plug-and-perf assembly is then removed from the hydrocarbon well 100, and the high-pressure slurry 140 of fracturing fluid is pumped down the hydrocarbon well 100, through the first set of perforation clusters 152A within the first stage 150A, and into the surrounding reservoir 108, forming a first set of fractures 154A within the reservoir 108. Moreover, the proppant 132 in the high-pressure slurry 140 serves to hold the fractures 154A open after the hydraulic pressures are released.

The plug-and-perf assembly is then lowered back into the hydrocarbon well 100 and used to enable hydraulically fracturing of the second stage 150B of the hydrocarbon well 100. This involves using the plug-and-perf assembly to set a first frac plug 156A within the production casing string 114 to isolate the first stage 150A of the hydrocarbon well 100 from the second stage 150B of the hydrocarbon well 100. Specifically, a setting tool (not shown) within the plug-and-perf assembly is used to set the first frac plug 156A against the inner diameter of the production casing string 114 upstream of the first set of perforation clusters 152A. Moreover, during the setting process, the force generated by the setting tool causes the setting tool to shear off the first frac plug 156A, leaving the first frac plug 156A set within the hydrocarbon well 100.

Once the first frac plug 156A has been set within the production casing string 114, the perforating gun is detonated to create a second set of perforation clusters 152B within a second stage 150B of the hydrocarbon well 100. The plug-and-perf assembly is then removed from the hydrocarbon well 100, and the high-pressure slurry 140 of fracturing fluid is pumped down the hydrocarbon well 100, through the second set of perforation clusters 152B, and into the surrounding reservoir 108, forming a second set of fractures 154B in the reservoir 108.

In various embodiments, this plug-and-perforation process is used to perforate and fracture every stage within the hydrocarbon well 100. For example, according to the embodiment shown in FIG. 1A, the plug-and-perforation process is used to create a third set of perforation clusters 152C and a third set of fractures 154C within a third stage 150C of the hydrocarbon well 100, a fourth set of perforation clusters 152D and a fourth set of fractures 154D within a fourth stage 150D of the hydrocarbon well 100, and a fifth set of perforation clusters 152E and a fifth set of fractures 154E within a fifth stage 150E of the hydrocarbon well 100. Moreover, while only five stages 150A-E are shown in FIG. 1A, it is to be understood that a typical extended-reach lateral well may include around 20-50 stages, and some ultra-extended-reach lateral wells may include more than 100 stages. Furthermore, while only one set of fractures 154A-E is shown for each stage 150A-E in FIG. 1A, each stage 150A-E may include a total of around 3-20 sets of fractures, with each set of fractures being spaced around 10-100 feet apart, as discussed above with respect to the sets of perforation clusters 152A-E.

During the hydraulic fracturing process, the injection rate of the high-pressure slurry 140 may be increased until it reaches a maximum injection rate of around 20-150 barrels per minute (bbl/min). In operation, approximately 5,000 to 15,000 barrels of the high-pressure slurry 140 may be injected during the hydraulic fracturing of each stage 150A-E.

Because the fractures 154A-E within the near-wellbore region of the reservoir 108 provide the flow channels for the extraction of hydrocarbon fluids from the reservoir 108, the success of the hydraulic fracturing process has a direct impact on the amount of hydrocarbon fluids that may be recovered from the reservoir 108. Specifically, the numbers, sizes, and locations of the fractures 154A-E corresponding to the perforation clusters 152A-E directly impact the amount of hydrocarbon fluids that are able to mobilize and flow into the hydrocarbon well 100. As a result, accurate fracture characterization is essential for enabling optimized well planning and efficient stimulation of the wellbore.

Moreover, because multiple perforation clusters 152A-E are stimulated simultaneously to create multiple fractures 154A-E within each stage 150A-E of the hydrocarbon well 100, it can be difficult to control how much fracturing fluid and proppant exits each perforation cluster and, thus, how large each resulting fracture becomes, in part because the rock properties, local rock stresses, cement quality, and other factors vary with well length. In fact, fractures frequently do not even initiate at some perforation clusters due to the rock surrounding those clusters having different geomechanical properties than the rock surrounding the other perforation clusters in the same stage. It is generally believed that each fracture within a stage should be created with the same geometry and quality in order to maximize well production with a given well spacing. Therefore, a stage is considered inefficient when it includes fractures of different sizes, or when there is an absence of one or more intended fractures. This inefficiency may be addressed in part by changing the perforation design, such as by reducing the total number of perforations in a stage (referred to as "limited entry"), varying the number of perforations across a stage, or plugging perforations during the treatment (referred to as "intra-stage diversion"). Upfront knowledge of the rock properties within a stage can also be utilized to attempt to design the optimal number of perforations within each cluster such that even fracture lengths are created within each stage. Moreover, measurements relating to the number and quality of the fractures formed within each stage are very useful for evaluating and adjusting the perforation and/or diversion strategy to optimize the fracture geometries within each stage.

Therefore, embodiments described herein provide a high-frequency tube wave generator 158 and a high-frequency, high-sensitivity pressure receiver 160 for collecting data relating to wellbore characteristics. More specifically, the high-frequency tube wave generator 158 is configured to generate high-frequency pressure transients, or tube waves, 162 within the wellbore 102, while the high-frequency, high-sensitivity pressure receiver 160 is configured to record data relating to the generated high-frequency tube waves 162 and a time-delayed series of reflected high-frequency tube waves 164 returning from the wellbore 102. The data may then be used to analyze various wellbore characteristics. For example, the data may be used to analyze the number of perforation clusters for which fractures have formed within a particular stage of the hydrocarbon well 100, the sizes of the fractures corresponding to the perforation clusters for which fractures have formed, the locations of the perforation clusters for which fractures have formed, and/or the number of perforation clusters that have been stimulated to at least a threshold level as measured by the characteristics of the fractures corresponding to the perforation clusters within the particular stage. Moreover, in some embodiments, the determination of whether a particular perforation cluster has been stimulated to at least a threshold level may be made, at least in part, based on the growth or erosion of the perforations and, thus, the sizes of the resulting fracture entrances.

According to the embodiment shown in FIG. 1A, the high-frequency tube wave generator 158 and the high-frequency, high-sensitivity pressure receiver 160 are hydraulically coupled to the wellbore 102 via direct connection with the wellhead 142. However, the high-frequency tube wave generator 158 and/or the high-frequency, high-sensitivity pressure receiver 160 may be hydraulically coupled to the wellbore 102 in any suitable manner. For example, in some embodiments, the high-frequency tube wave generator 158 and/or the high-frequency, high-sensitivity pressure receiver 160 are positioned inside the wellbore 102. In such embodiments, the high-frequency tube wave generator 158 and/or the high-frequency, high-sensitivity pressure receiver 160 may be lowered into the wellbore 102 using a wireline, and may be positioned within the surface or intermediate casing strings 110 or 112, or within the production casing string 114 proximate to the stage of interest. Moreover, while both the high-frequency tube wave generator 158 and the high-frequency, high-sensitivity pressure receiver 160 are depicted as single units in FIG. 1A, the high-frequency tube wave generator 158 and/or the high-frequency, high-sensitivity pressure receiver 160 may optionally include multiple units located in different places throughout the wellbore 102 and/or at the wellhead 142. For example, in some embodiments, high-frequency, high-sensitivity pressure receivers 160 may be located at least every 100 meters, at least every 10 meters, or at least every 1 meter within the casing strings 110, 112, and/or 114, with an additional high-frequency, high-sensitivity pressure receiver 160 optionally located at the wellhead 142. Including multiple high-frequency, high-sensitivity pressure receivers 160 within the hydrocarbon well 100 in this manner allows for the collection of dynamic, highly-accurate data relating to the high-frequency tube waves 162 and 164 traveling up and down the wellbore 102.

In some embodiments the positioning of the receiver 160 and/or the high-frequency tube wave generator 158 is modified based on the receiver's signal-to-noise ratio limit. Specifically, if the receiver's signal-to-noise ratio limit is too low for a remote measurement taken from the wellhead 142, the receiver 160 and/or the high-frequency tube wave generator 158 may be positioned within the wellbore 102 closer to the stage of interest.

According to embodiments described herein, the high-frequency tube wave generator 158 is a highly-controllable, highly-repeatable acoustic source that is configured to generate the high-frequency tube waves 162 within the wellbore 102. The high controllability of the high-frequency tube wave generator 158 ensures that tube waves including a selected waveform containing a specific bandwidth of high-frequency components can be generated within the wellbore 102. Moreover, the high repeatability of the high-frequency tube wave generator 158 ensures that the tube waves can be generated in the same manner multiple times. This is essential for ensuring the accuracy of the collected data during the hydraulic fracturing process for each individual stage, as well as ensuring that the collected data can be used to compare the results of the hydraulic fracturing process for different stages.

In some embodiments, the high-frequency tube wave generator 158 is configured to generate multiple discrete high-frequency tube waves 162 with waveforms containing narrow frequency components to cover a broad frequency band. Specifically, to prevent interference between the generated and reflected high-frequency tube waves 162 and 164, the high-frequency tube wave generator 158 may generate a series of individual high-frequency tube waves 162 within the wellbore 102. Each individual high-frequency tube wave 162 may include a frequency range that is a predetermined increment of the specific bandwidth of high-frequency components. For example, if the high-frequency tube waves 162 are generated in 50-Hz increments for a specific bandwidth of 200-2,000 Hz, the first high-frequency tube wave may be a selected waveform including a frequency range of 200-250 Hz, the second high-frequency tube wave may be a selected waveform including a frequency range of 250-300 Hz, the third high-frequency tube wave may be a selected waveform including a frequency range of 300-350 Hz, and so on, until reaching the final high-frequency tube wave, which may be a selected waveform including a frequency range of 1,950-2,000 Hz. In addition, each high-frequency tube wave 162 may be generated at a different time slot, with the time interval between each time slot being long enough to allow the previous high-frequency tube wave to fully attenuate and, thus, prevent interference between the generated and reflected high-frequency tube waves 162 and 164. The time interval between each time slot may be, for example, around 1 minute, depending on the details of the specific implementation.

The high-frequency tube wave generator 158 may include one or more high-speed valves attached to the wellhead 142. In some embodiments, the wellbore 102 is first pressurized to a predetermined pressure level, and the high-frequency tube wave generator 158 then generates the high-frequency tube waves 162 by partially depressurizing the wellbore 102. Specifically, the one or more high-speed valves may open, allowing a portion of the fracturing fluid (or other fluid) within the wellbore 102 to bleed off to open air or to a storage container, such as the storage container 166 shown in FIG. 1A, and then quickly close with the aid of one or more corresponding high-speed actuators. In other embodiments, the high-frequency tube wave generator 158 generates the high-frequency tube waves 162 by increasing the pressure within the wellbore 102. Specifically, the one or more high-speed valves may be used to inject fracturing fluid, or any other suitable type of fluid, from the pressurized storage container 166 into the wellbore 102 in a controlled manner. While various different devices and configurations can be used for this purpose, two exemplary embodiments of the high-frequency tube wave generator 158 are described with respect to FIGS. 1B and 1C.

Moreover, while embodiments described herein primarily relate to the use of one or more high-speed valves for the high-frequency tube wave generator 158, it is to be understood that the high-frequency tube wave generator 158 may also include any other suitable device or system that is capable of generating controllable, repeatable high-frequency tube waves 162 within the wellbore 102. For example, in some embodiments, the perforating gun that is used for the hydraulic fracturing process may also function as the high-frequency tube wave generator 158, since firing the perforating gun in the production casing string 114 will generate a pressure pulse throughout the wellbore 102. As another example, in some embodiments, the high-frequency tube wave generator 158 includes one or more rupture disks that are configured to fail, or rupture, in response to the wellbore 102 being pressurized to the predetermined pressure level or in response to being physically triggered to fail via a command from the operator of the mobile command center 144, for example. Failure of the one or more rupture disks causes a short, rapid pressure pulse within the wellbore 102 that is controlled via the quick closure of one or more valves located proximate to the one or more rupture disks, thus generating the desired high-frequency tube waves 162. Moreover, in such embodiments, the entire high-frequency tube wave generator 158 may be designed to be easily detached from the wellhead 142 so that the one or more rupture disks may be replaced for the next iteration of the fracture diagnostic process.

As another example, in some embodiments, the high-frequency tube wave generator 158 includes a fast-acting valve that is connected to the wellbore 102 via a short pipe that is empty or at low pressure. When the valve is opened, pressurized fluid from the wellbore 102 rushes into the short pipe. This fluid bleed-off initiates a wave that oscillates between the entrance and the tip of the short pipe until pressure equilibrium is reached. The oscillation frequency is determined by the length of the pipe and the sound speed within the fluid inside the pipe. This oscillating wave can act as the high-frequency tube wave 162 traveling down the wellbore 102. This embodiment is described further with respect to FIGS. 5A and 5B.

As another example, in some embodiments, the high-frequency tube wave generator 158 includes a piezoelectric crystal-based source, which is essentially an accelerometer that is capable of generating tube waves with a selected waveform containing narrow frequency components. This type of high-frequency tube wave generator may be easier to control than other types of high-frequency tube wave generators described herein. More specifically, it may be easier to control the specific waveform of the generated tube waves using this type of high-frequency tube wave generator. However, it may not offer enough power to travel very long distances. Downhole data have shown that a 100 KHz signal can propagate in a fluid column for around 400-600 feet, one way. Therefore, this type of high-frequency tube wave generator may be successfully used to analyze a particular stage within the wellbore 102 for embodiments in which the high-frequency tube wave generator 158 and the high-frequency, high-sensitivity pressure receiver 160 are deployed inside the production casing string 114, proximate to the stage of interest. In various embodiments, the high-frequency tube waves generated by the piezoelectric crystal-based source are Hanning windowed sinusoidal waveforms with narrow frequency components. Generating multiple tube waves with narrow frequency components helps to prevent distortion of the waveform due to frequency-dependent attenuation and dispersion. This concept is described further with respect to FIGS. 6A and 6B.

Furthermore, as another example, in some embodiments, the high-frequency tube wave generator 158 includes an explosive shock pulse generator. This class of pressure sources relies on small explosive charges, such as, for example, blank cartridges, detonation chords, pellets, and powders. During operation, the chemical energy stored in the explosive is released in a detonation wave which, depending on the choice of explosive, can have detonation velocities ranging from around 150 m/s to around 10,000 m/s. Most commercial mining explosives have supersonic detonation velocities ranging from around 1800 m/s to around 8000 m/s. Low explosives have detonation velocities that are subsonic and burn at a rate of around 150 m/s to around 650 m/s. Examples of low explosives are black powder and smokeless gunpowder. When an explosive charge is detonated, the immediate result is a very high near-field pressure that rises roughly in the form of an exponential spike. The shape and, hence, the frequency content of the spike is determined by the amount of charge, the detonation velocity, and whether the explosive charge is shaped in any manner.

In such embodiments, the explosive shock pulse generator may be located in a relatively small-volume cavity or pipe that is connected by a valve to the wellbore 102. The valve may be a gate valve that is open to the wellbore 102 when the explosive charge is fired. In this embodiment, the explosive charge is designed so that the pressure field transmitted through the open valve directly excites high-frequency tube waves including a selected waveform with a specific bandwidth of high-frequency components. Frequency content is controlled by the dimensions of the valve cavity and the pipe, the type and amount of explosive used, and the shape of the explosive charge. In some embodiments, the explosive charge includes low explosive material.

Furthermore, in such embodiments, the explosive shock pulse generator is designed such that the explosive can be changed out. For example, the small-volume cavity or pipe may be connected to another valve or a removable flange through which the explosive can be loaded. Another way of changing out the charge would be a mechanical load lock assembly such as that found in many firearms. In addition, in some embodiments, the explosive shock pulse generator is designed such that the explosive may be fired either electronically or mechanically.

In another embodiment, the explosive shock pulse generator has all of the features of the previous embodiment, but employs a larger-volume cavity or pipe that is connected by a valve to the wellbore 102. In this embodiment, the resonance of the cavity modulates the frequency content of the pressure pulse delivered to the wellbore 102, where the term "resonance" is taken to mean that the roundtrip time from end to end of the cavity or pipe can be used to generate a pressure envelope. If the pressure pulse from the detonation wave is short enough, the envelope consists of a series of individual pressure spikes from transit time back and forth (i.e., from end to end) of the cavity or pipe. By designing or controlling the length of the round trip time, the frequency content of the envelope can be adjusted.

In another embodiment, the high-frequency tube wave generator 158 includes a floating piston that is driven by an explosive detonation. The explosive charge used for the detonation may be as described above with respect to explosive shock pulse generators.

According to embodiments described herein, the high-frequency, high-sensitivity pressure receiver 160 is a highly-sensitive pressure acquisition system that is capable of recording direct, high-frequency pressure pulses, i.e., the generated high-frequency tube waves 162 and the reflected high-frequency tube waves 164. The recording duration may be at least 30 seconds, at least 1 minute, at least 5 minutes, or at least 10 minutes, for example, depending on the length of the hydrocarbon well 100 and the depth of the stage 150A-E of interest. The high sensitivity of the high-frequency, high-sensitivity pressure receiver 160 allows for precise recording of pressure pulses including selected waveforms containing specific bandwidths of high-frequency components. Moreover, while various different devices and configurations can be used for this purpose, two exemplary embodiments of the high-frequency, high-sensitivity pressure receiver 160 are described with respect to FIGS. 1B and 1C.

According to the embodiment shown in FIG. 1A, the high-frequency tube wave generator 158 and the high-frequency, high-sensitivity pressure receiver 160 are being used to analyze fracture characteristics corresponding to the fifth, and final, stage 150E of the hydrocarbon well 100. However, it is to be understood that the high-frequency tube wave generator 158 and the high-frequency, high-sensitivity pressure receiver 160 may be used to analyze fracture characteristics corresponding to each stage 150A-E within the hydrocarbon well 100 as the hydraulic fracturing process progresses.

As described above, the hydraulic fracturing process involves injecting the high-pressure slurry 140 at an injection rate of around 20-150 bbl/min to create the sets of fractures 154A-E within the different stages 150A-E of the hydrocarbon well 100. However, during the hydraulic fracturing process, there are many times when the wellbore 102 is filled with a column of pressurized fracturing fluid, or slickwater, that is static (or near static) and can be used as an acoustic waveguide for propagating high-frequency tube waves. This may occur immediately after a particular stage 150A-E has been fractured and/or immediately before a corresponding frac plug 156A-D has been set, for example. In various embodiments, the fracture diagnostic technique is preferably performed when the fluid column within the wellbore 102 is pressurized and flowing at a rate of less than 10 bbl/min, less 5 bbl/min, less than 1 bbl/min, or, most preferably, when the fluid column is static. The acoustic waveguide properties of the fluid within the wellbore 102 are ideal during this time, meaning that the high-frequency tube waves 162 will suffer less attenuation when the fluid column within the wellbore 102 is static (or near static) than when the fluid column within the wellbore 102 is flowing. Under these conditions, the high-frequency tube waves 162 generated by the high-frequency tube wave generator 158 easily propagate inside the fluid column within the wellbore 102. The high-frequency tube waves 162 are then reflected at various interfaces within the wellbore 102 that include acoustic impedance mismatches, or boundaries. According to the embodiment shown in FIG. 1A, the reflection points, or reflectors, of interest are the interfaces between the wellbore 102 and the entry point for each set of fractures 154A-E within the corresponding stages 150A-E of the hydrocarbon well 100. However, embodiments described herein may also be used to analyze other wellbore characteristics, since acoustic impedance boundaries arise from changes in cross-sectional area within the wellbore 102 and/or changes in the acoustic wave speed of the high-frequency tube waves 162 propagating through the wellbore 102. As a result, the casing joints, liner hangers, valves, sand bridges, and plugs within the wellbore 102 all act as reflectors for the high-frequency tube waves 162. Moreover, each transmitted high-frequency tube wave 162 may encounter multiple reflectors as it propagates through the wellbore 102, resulting in a series of bifurcated tube waves with different travel paths within the wellbore 102.

In various embodiments, the high-frequency, high-sensitivity pressure receiver 160 monitors the pressures of the high-frequency tube waves 162 and the reflected high-frequency tube waves 164 in the time domain as they reach the wellhead 142, and/or as they travel through the wellbore 102 (in embodiments in which one or more high-frequency, high-sensitivity pressure receivers 160 are located within the wellbore 102). This data represents a complicated set of interactions between reflected high-frequency tube waves 164 and transmitted high-frequency tube waves 162 with different travels paths due to their behavior at different acoustic impedance boundaries. Moreover, the reflected high-frequency tube waves 164 will be attenuated due to viscous losses in the acoustic waveguide, with the degree of attenuation being frequency dependent, as described further with respect to FIG. 2.

The quality of information provided by the reflected high-frequency tube waves 164 is strongly dependent on the frequency of the generated high-frequency tube waves 162. More specifically, the high-frequency tube waves' interaction with the reflectors of interest, i.e., the interfaces between the wellbore 102 and the entry points for each set of fractures 154A-E, is frequency dependent. In general, higher frequency tube waves exhibit lower reflectivity at reflection points, such as at the wellbore/fracture interfaces. Therefore, using higher frequency tube waves enables larger numbers of wellbore/fracture interfaces, aligned in series with respect to the incoming tube waves, to be detected, particularly when attenuation of the high-frequency tube waves can be tolerated. Furthermore, higher frequency tube waves have shorter wavelengths and, thus, provide higher spatial resolution for separating closely-located wellbore/fracture interfaces. Accordingly, in some embodiments, frequencies of at least 10 Hertz (Hz) constitute at least 10% of the acoustic power in the generated high-frequency tube waves 162, which may correspond to a spatial resolution of less than around 100 meters. More preferably, in other embodiments, frequencies of at least 100 Hz constitute at least 10% of the acoustic power in the generated high-frequency tube waves 162, which may correspond to a spatial resolution of less than around 10 meters. Even more preferably, in other embodiments, frequencies of at least 1,000 Hz constitute at least 10% of the acoustic power in the generated high-frequency tube waves 162, which may correspond to a spatial resolution of less than around 1 meter.

In various embodiments, the reflected high-frequency tube waves 164 travel a roundtrip distance in excess of around 10,000 feet. Therefore, the pressure amplitudes of the generated high-frequency tube waves 162 may be controlled such that acceptable signal-to-noise ratios are obtained even after attenuation of the tube waves across such long distances. In some embodiments, acceptable signal-to-noise ratios are obtained by generating high-frequency tube waves 162 with maximum pressure amplitudes of at least 0.1 pounds per square inch (psi), at least 1 psi, at least 10 psi, or most preferably, at least 100 psi. Moreover, in various embodiments, the high-frequency, high-sensitivity pressure receiver 160 may be configured with a high degree of resolution such that valuable information can be obtained from reflected high-frequency tube waves 164 that are highly attenuated. For example, in some embodiments, the high-frequency, high-sensitivity pressure receiver 160 is configured to resolve pressures that are a part in one thousand, a part in ten thousand, or most preferably, a part in one hundred thousand of the maximum pressure amplitude of the generated high-frequency tube waves 162.

In various embodiments, an upper limit for the frequency of the tube waves 162 is between around 4,000 and around 10,000 Hz. This upper frequency limit may be selected based, at least in part, on the diameter of the casing strings 110, 112, and 114 within the hydrocarbon well 100. More specifically, the upper frequency limit may be selected based on two factors. The first factor is the expected attenuation due to the tube waves' interactions with the walls of the casing strings 110, 112, and 114, as described further with respect to FIG. 2. The second factor is the minimum wavelength that can be tolerated for the high-frequency tube waves 162 such that the wavelength does not drop below the diameter of the smallest casing, i.e., the production casing string 114 within the hydrocarbon well 100. Once the wavelengths of the high-frequency tube waves are less than the diameter of the smallest casing, the tube waves become dispersive, meaning that they will begin to follow multiple different paths. This may cause the reflected high-frequency tube waves 164 to be distorted, resulting in signal processing challenges that jeopardize the success of the fracture diagnostic process. Therefore, in various embodiments, the wavelengths for the high-frequency tube waves 162 are at least double or at least triple the diameter of the smallest casing in the hydrocarbon well 100. As an example, if the wavelengths of the tube waves are selected to be at least double the diameter of the production casing string 114, and the production casing string 114 is 5 inches in diameter, the wavelengths for the high-frequency tube waves 162 may be at least 10 inches, or 0.25 meters. If the sound speed is 1,500 meters per second (m/s), this correlates to an upper frequency limit of around 6,000 Hz. As another example, if the wavelengths of the tube waves are selected to be at least triple the diameter of the production casing string 114, and the production casing string 114 is 5 inches in diameter, the wavelengths for the high-frequency tube waves 162 may be at least 15 inches, or 0.38 meters. If the sound speed is 1,500 meters per second (m/s), this correlates to an upper frequency limit of around 4,000 Hz.

In various embodiments, the recorded data relating to the generated and reflected high-frequency tube waves 162 and 164 can be analyzed to determine the nature of the acoustic impedance boundaries, or reflection points, within the hydrocarbon well 100. For example, the recorded data may be used to analyze the number of perforation clusters for which open fractures (or fracture clusters) have formed, the geometry of the fractures corresponding to each perforation cluster for which open fractures have formed, and/or the location of the perforation clusters for which fractures have formed within a corresponding stage 150A-E of the hydrocarbon well 100. This analysis may be performed using a robust physical model relating to wave propagation within the wellbore 102. In some embodiments, the physical model includes means for analyzing the times of flight of the reflected high-frequency tube waves 164 to infer the locations of the fracture clusters and other reflectors, means for analyzing the reflectivity of the high-frequency tube waves 162 and 164, as determined by the change in magnitude between the generated high-frequency tube waves 162 and the reflected high-frequency tube waves 164, to infer the size of each fracture entrance, and/or means for analyzing the reflected high-frequency tube waves 164 based on the first arrival principle to identify the number of fractures or clusters in each stage 150A-E. In principle, this type of physical model may be implemented in the form of an inversion algorithm. Moreover, as described herein, the recorded data provides the most insight into the nature of the acoustic impedance boundaries when the tube waves 162 are generated within a desired frequency band that includes relatively high frequencies.

In some embodiments, it is difficult to analyze the fracture characteristics within the hydrocarbon well 100 due to the complexity of the reflected high-frequency tube waves 164. This problem is most pronounced when the high-frequency tube waves encounter multiple acoustic impedance boundaries, such as acoustic impedance boundaries caused by casing joints, liner hangers, valves, plugs, sand bridges, and other reflectors within the casing of the hydrocarbon well 100. To solve this problem, in some embodiments, the high-frequency tube wave generator 158 and the high-frequency, high-sensitivity pressure receiver 160 are used to measure the pressure response of the hydrocarbon well 100 right after the plug is set and before fractures are formed for a particular stage 150A-E. The resulting data are then used as a baseline pressure response that may be compared to the pressure response after the sets of fractures 154A-E are formed. In this manner, similarities between the baseline pressure response and the pressure response after fracturing may be easily attributed to reflectors that are always present within the hydrocarbon well 100. This, in turn, makes it easier to determine the fracture characteristics within the particular stage 150A-E of the hydrocarbon well 100.

Moreover, in some embodiments, the pressure response of the hydrocarbon well 100 is only measured once after the fracturing of each stage 150A-E. However, in other embodiments, the pressure response is measured multiple times during the fracturing of each stage 150A-E. Measuring the pressure response multiple times during the fracturing of a particular stage 150A-E allows the progress of the fracture growth within the particular stage 150A-E to be closely monitored and provides additional pressure responses at different timings to compare to the baseline pressure response for the particular stage 150A-E. For example, the pressure response may be measured multiple times during the pad phase at the beginning of the hydraulic fracturing of a particular stage 150A-E to allow the growth of the fractures 154A-E within the particular stage 150A-E to be analyzed prior to injecting proppant into the fractures 154A-E.

Figure 1B:
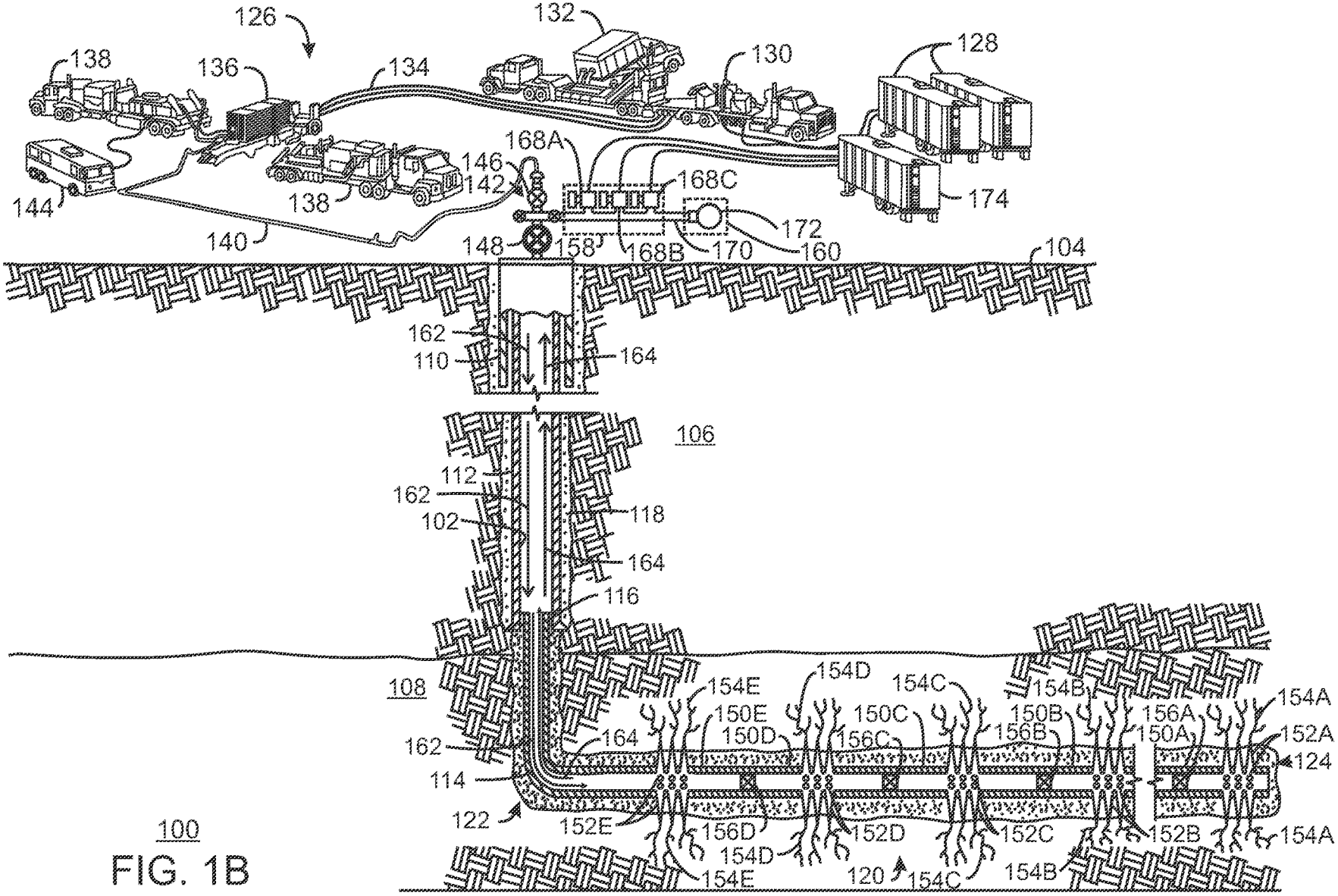
FIG. 1B is a schematic view of the hydrocarbon well showing an exemplary embodiment of the fracture diagnostic equipment described herein.

FIG. 1B is a schematic view of the hydrocarbon well 100 showing an exemplary embodiment of the fracture diagnostic equipment described herein. Like numbered items are as described with respect to FIG. 1A. According to the embodiment shown in FIG. 1B, the high-frequency tube wave generator 158 includes three valves 168A-C arranged in a parallel configuration. The valves 168A-C may be electrically or hydraulically controlled valves with actuators that are configured to open and close very quickly in a synchronized, highly-controllable, highly-repeatable manner. For example, the valves 168A-C may be high-speed solenoid valves and/or pilot-operated relief valves, such as pilot-operated solenoid valves. Further, in various embodiments, the valves 168A-C are connected to the wellhead 142 via a tubing 170, such as a steel tubing or other pipe. In addition, the high-frequency, high-sensitivity pressure receiver 160 includes a high-frequency pressure transducer 172 located downstream of the valves 168A-C on the same tubing 170.

In various embodiments, the fracture diagnostic process involves pressurizing the wellbore 102 to a predetermined pressure level that is above ambient pressure. This may be accomplished by injecting the high-pressure slurry 140 of fracturing fluid into the wellbore 102 via the wellhead 142 until the pressure within the wellbore 102 reaches the predetermined pressure level. The predetermined pressure level may vary depending on the details of the specific implementation, but will generally not exceed the lithostatic pressure within the formation 106. For example, the predetermined pressure level may be between around 5,000 to 10,000 psi or, more preferably, between around 2,000 to 7,000 psi.

After the wellbore 102 has been pressurized, the valves 168A-C are opened for a predetermined amount of time, allowing a fixed amount of fracturing fluid (or other fluid) to bleed off from the wellbore 102 to open air or to a storage container, such as the fluid storage tank 174 shown in FIG. 1B. This creates a controlled pressure dip in the wellbore 102, thus generating the high-frequency tube waves 162. In various embodiments, the predetermined amount of time for opening and closing the valves 168A-C is determined based on the known valve coefficient (Cv) and the desired magnitude, duration, and frequency of the generated tube waves 162. In some embodiments, the predetermined amount of time is around 1 to 10 milliseconds (ms), which corresponds to an upper frequency limit of above 100-1,000 Hz.

In some embodiments, the valve actuators are electronically synchronized such that the valves 168A-C open and close in a predetermined sequence and with a predetermined number of cycles to generate high-frequency tube waves 162 with the desired spectral shape. Moreover, as described further with respect to FIG. 5, the valves 168A-C may be closely coupled to the wellbore 102 to preserve the desired spectral shape of the high-frequency tube waves 162. For example, the distance between the center of the wellhead 142 and the location of the first valve 168A on the tubing 170 may be less than 50 feet, less than 20 feet, less than 5 feet, or less than 1 foot, depending on the details of the specific implementation. Furthermore, to prevent interference between the generated and reflected high-frequency tube waves 162 and 164, the high-frequency, high-sensitivity pressure receiver 160 and the high-frequency tube wave generator 158 may be located at a predetermined minimum distance from each other. For example, the distance between the last valve 168C and the high-frequency pressure transducer 172 on the tubing 172 may be at least 5 feet, at least 10 feet, at least 15 feet, or at least 20 feet, depending on the details of the specific implementation. In operation, this minimum distance may be determined based on the desired duration of each high-frequency tube wave 162.

As described above, the high-frequency pressure transducer 172 may be configured to resolve pressures that are a part in one thousand, a part in ten thousand, or most preferably, a part in one hundred thousand of the maximum pressure amplitude of the generated high-frequency tube waves 162. In some embodiments, the high-frequency pressure transducer 172 is a commercially-available pressure transducer that is capable of measuring voltage responses over 3-4 orders of magnitude. As described further with respect to FIG. 2, this type of pressure transducer is capable of successfully detecting reflected tube waves 164 with a frequency of 1,000 Hz after they have traveled around 40,000 feet roundtrip within the wellbore 102.

Figure 1C:
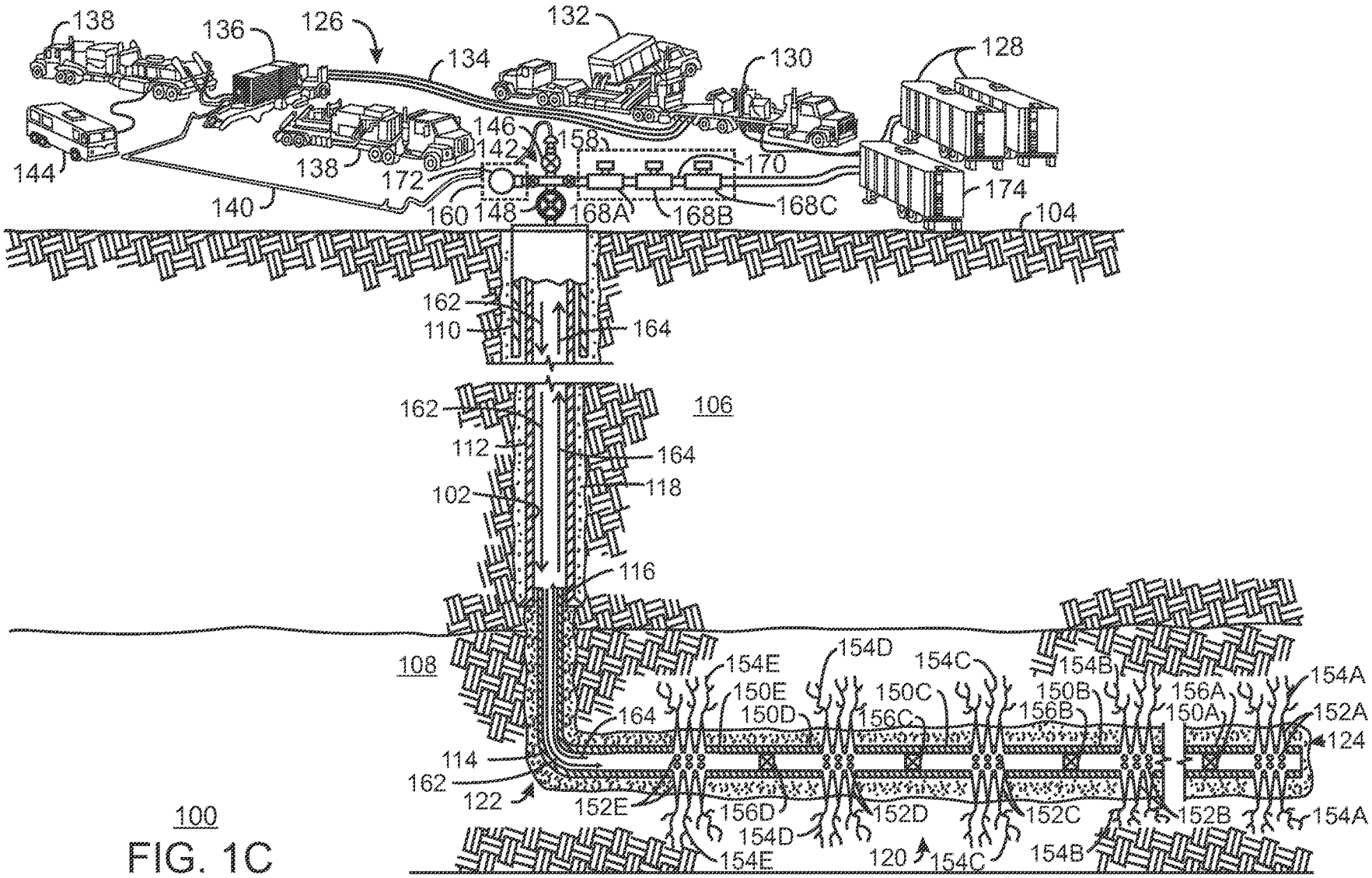
FIG. 1C is a schematic view of the hydrocarbon well showing another exemplary embodiment of the fracture diagnostic equipment described herein.

FIG. 1C is a schematic view of the hydrocarbon well 100 showing another exemplary embodiment of the fracture diagnostic equipment described herein. Like numbered items are as described with respect to FIGS. 1A and 1B. The embodiment shown in FIG. 1C is very similar to the embodiment shown in FIG. 1B. However, according to the embodiment shown in FIG. 1C, the valves 168A-C of the high-frequency tube wave generator 158 are arranged in series rather than in parallel. Moreover, the high-frequency pressure transducer 172 is positioned on a separate wellhead attachment, rather than on the same tubing 170 as the valves 168A-C. This helps to prevent interference between the generated and reflected high-frequency tube waves 162 and 164.

While the high-frequency tube wave generator 158 includes three valves 168A-C according to the embodiments shown in FIGS. 1B and 1C, the high-frequency tube wave generator 158 may also be configured with only one valve 168. Moreover, in some embodiments, the high-frequency tube wave generator 158 includes a larger number of valves 168, such as, for example, at least 5 or at least 10 valves. In general, adding additional valves 168 to the high-frequency tube wave generator 158 allows for the generation of tube waves 162 with higher pressure amplitudes. Furthermore, in some embodiments, the separation distance between each valve 168 is specifically selected to control the characteristics of the generated waveforms of the high-frequency tube waves 162.

The schematic views of FIGS. 1A-C are not intended to indicate that the hydrocarbon well 100 is to include all of the components shown in FIGS. 1A-C, or that the hydrocarbon well 100 is limited to only the components shown in FIGS. 1A-C. Rather, any number of components may be omitted from the hydrocarbon well 100 or added to the hydrocarbon well 100, depending on the details of the specific implementation. For example, while only one lateral section 120 is shown in FIG. 1A, the hydrocarbon well 100 may include multiple lateral, deviated, or highly-deviated sections extending in various directions throughout the formation 106. In such embodiments, the high-frequency tube wave generator 158 and the high-frequency, high-sensitivity pressure receiver 160 may be used to characterize fractures within each section separately. As another example, in some embodiments, the wellhead 142 is a splitter-type wellhead that connects to a number of hydrocarbon wells 100 within the formation 106. In such embodiments, the high-frequency tube wave generator 158 and the high-frequency, high-sensitivity pressure receiver 160 may be used to characterize fractures within each hydrocarbon well 100 separately, or, alternatively, each hydrocarbon well 100 may include its own downhole high-frequency tube wave generator(s) 158 and high-frequency, high-sensitivity pressure receiver(s) 160.

While FIGS. 1A-C relate to the use of the fracture diagnostic equipment described herein for a plug-and-perforation process, the fracture diagnostic equipment may also be used for any other suitable type of fracturing or stimulation process, such as, for example, a coiled tubing stimulation process or a sliding sleeve stimulation process. Moreover, while embodiments described herein primarily relate to the use of the high-frequency tube wave generator 158 and the high-frequency, high-sensitivity pressure receiver 160 for fracture diagnostics, the high-frequency tube wave generator 158 and the high-frequency, high-sensitivity pressure receiver 160 may also be used to diagnose and analyze a variety of other wellbore characteristics and conditions, in which case the high-frequency tube wave generator 158 and the high-frequency, high-sensitivity pressure receiver 160 may be generally referred to as "wellbore diagnostic equipment" rather than "fracture diagnostic equipment." For example, the high-frequency tube wave generator 158 and the high-frequency, high-sensitivity pressure receiver 160 may also be used to analyze locations and conditions relating to the casing joints, liner hanger(s), valves, plugs, sand bridges, and/or other reflectors within the hydrocarbon well 100. As another example, the high-frequency tube wave generator 158 and the high-frequency, high-sensitivity pressure receiver 160 may be used to identify blockages within the hydrocarbon well 100, such as, for example, sections of the hydrocarbon well 100 that have experienced asphaltene fouling, since such blockages may also act as reflectors for the high-frequency tube waves 162.

Furthermore, the high-frequency tube wave generator 158 and the high-frequency, high-sensitivity pressure receiver 160 may also be used to diagnose and analyze conditions within a pipeline, in which case the high-frequency tube wave generator 158 and the high-frequency, high-sensitivity pressure receiver 160 may be referred to as "pipeline diagnostic equipment." For example, the high-frequency tube wave generator 158 and the high-frequency, high-sensitivity pressure receiver 160 may be used to detect leakages, blockages, defects, and/or other acoustic reflectors in an oil pipeline or a water pipeline. In various embodiments, because the techniques described herein utilize high-frequency tube waves (i.e., tube waves with frequency components exceeding 200 Hz for the pipeline embodiment), such techniques provide improved accuracy, detection, and sensitivity for detecting such leakages, blockages, and/or defects as compared to previously-known techniques utilizing lower-frequency tube waves. Specifically, while existing techniques provide for the determination of whether leakages exist within a pipeline section and the approximate locations of those leakages (i.e., with >100 ft accuracy), the techniques described herein provide for the determination of detailed information relating to such leakages, such as the number of leakages, the size of each leakage, and the location of each leakage (i.e., with <20 ft accuracy) within a pipeline section. In some embodiments, this involves analyzing the collected data using complicated signal processing methods to account for the large number of reflection points, such as elbows, valves, and risers, included within a typical pipeline.

Characteristics of the High-Frequency Tube Waves Described Herein

Figure 2:
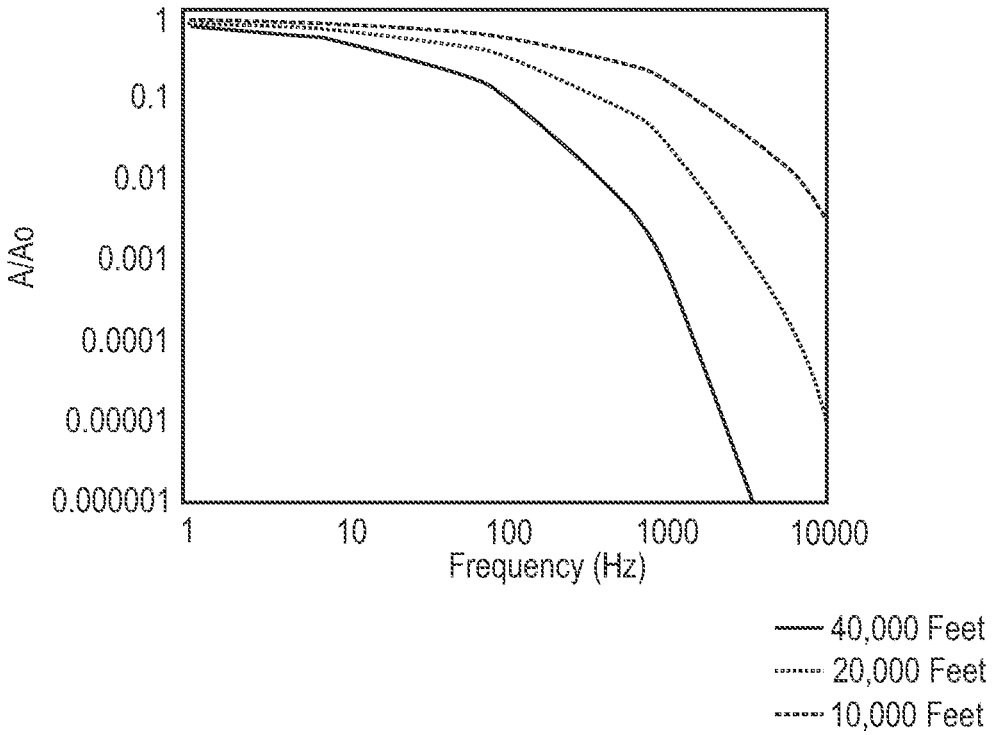
FIG. 2 is a graph showing the manner in which tube waves attenuate over different travel distances.

FIG. 2 is a graph 200 showing the manner in which tube waves attenuate over different travel distances. Specifically, the graph 200 shows a prediction of the amplitude ratio ($A/A_0$) for tube waves plotted as a function of frequency for travel distances of 10,000, 20,000, and 40,000 feet. The graph 200 was generated using a model with a 5-inch diameter steel pipe filled with water. The results of the model show that higher frequency information will be significantly attenuated after traveling a roundtrip distance ranging from 10,000 to 40,000 feet. Moreover, the results shown in the graph 200 merely provide a lower bound for attenuation. The attenuation can be significantly larger than that predicted by the graph 200 since the viscosity of fracturing fluid, or slickwater, is greater than that of water. Moreover, the coupling to the pipe and the cement within the wellbore is not fully accounted for in this simple model.

In operation, the reflected high-frequency tube waves are attenuated, at least in part, due to viscous losses in the acoustic waveguide, with the degree of attenuation being frequency dependent. A simple viscous waveguide model predicts that the quality factor (Q) that determines attenuation is approximately proportional to the ratio of the pipe radius to the viscous skin depth. In the context of this model, the attenuation is frequency dependent due to the frequency dependence of the skin depth as well as the frequency-dependent ratio between the quality factor and the attenuation coefficient.

However, despite the significant attenuation experienced at higher frequencies, high-frequency tube waves are still preferable because they provide the highest spatial resolution for analyzing reflection points. Moreover, FIG. 2 suggests that a commercially-available pressure transducer is capable of successfully detecting reflected tube waves with a frequency of 1,000 Hz after they have traveled around 40,000 feet roundtrip within the wellbore.

Figure 3:
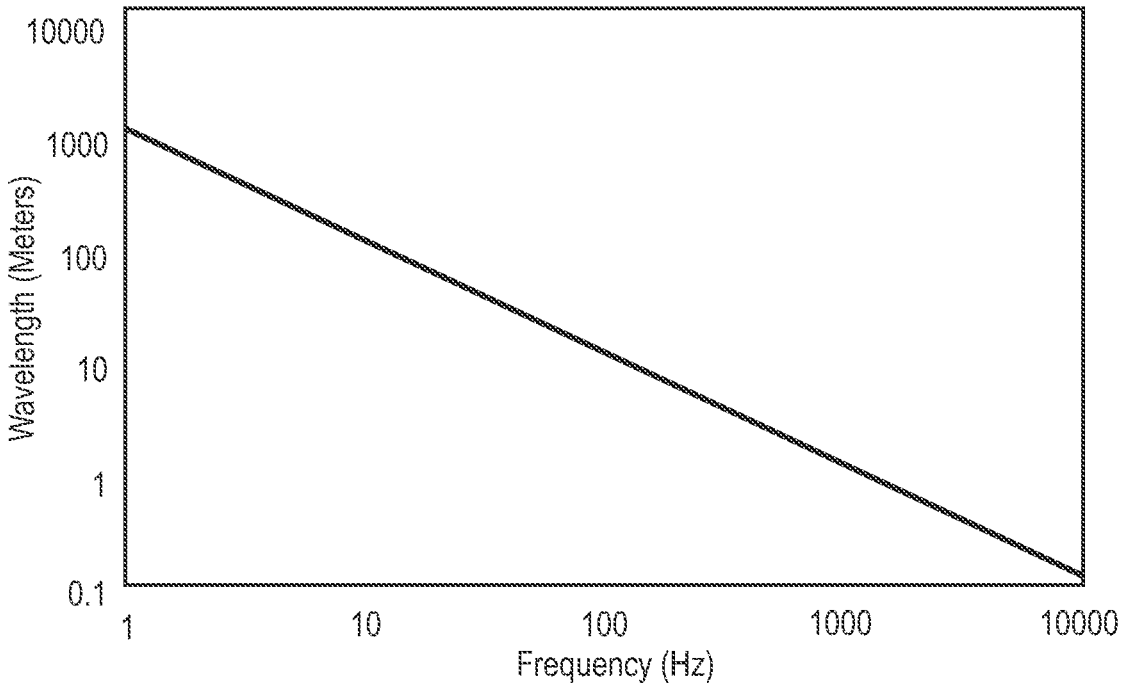
FIG. 3 is a graph showing the wavelength of a tube wave as a function of frequency.

FIG. 3 is a graph 300 showing the wavelength of a tube wave as a function of frequency. More specifically, the graph 300 shows a prediction of the wavelength of a tube wave in a wellbore with a sonic velocity of 1,400 m/s. Under those conditions, a tube wave with a frequency content of 1,000 Hz will have a wavelength of 1.4 meters. This short wavelength correlates to a higher spatial resolution, i.e., a spatial resolution of 1.4 meters. Moreover, a higher spatial resolution allows reflectors with the wellbore to be analyzed in greater detail.

Figure 4A:
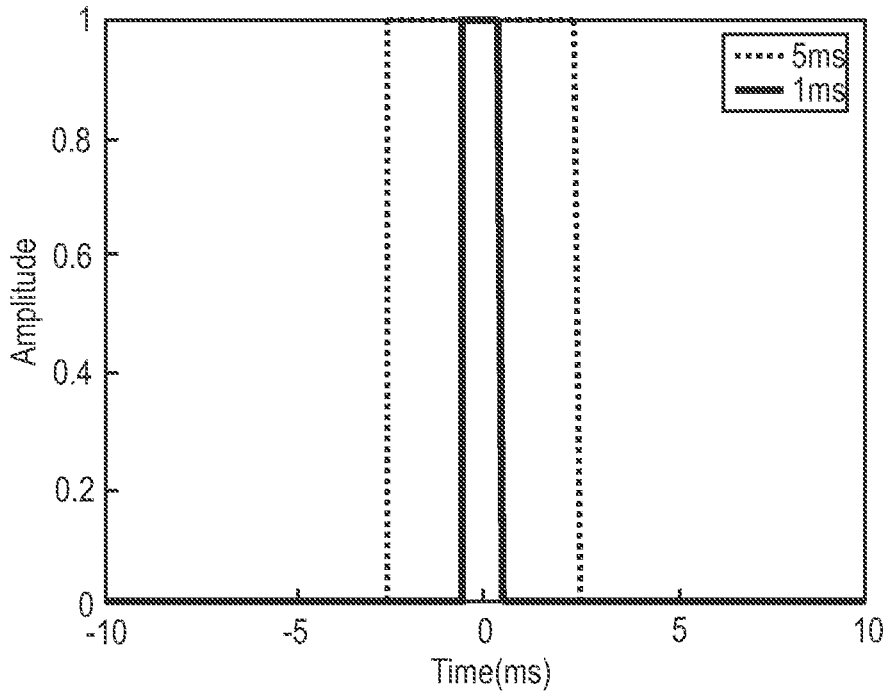
FIG. 4A is a graph showing two rectangular pressure pulses with different durations that may be used to generate the desired high-frequency tube waves.

FIG. 4A is a graph 400 showing two rectangular pressure pulses with different durations that may be used to generate the desired high-frequency tube waves. The two rectangular pressure pulses can be generated by opening and closing one or more high-speed, actuated valves to bleed off a portion of the fracturing fluid (or other fluid) from the wellbore or to inject high-pressure fracturing fluid into the wellbore, as described with respect to FIGS. 1A, 1B, and 1C. In operation, the rectangular pressure pulses are generated by opening and closing the one or more high-speed, actuated valves for a predetermined amount of time, i.e., for a total duration of 1 millisecond or 5 milliseconds according to the examples shown in FIG. 4A.

Figure 4B:
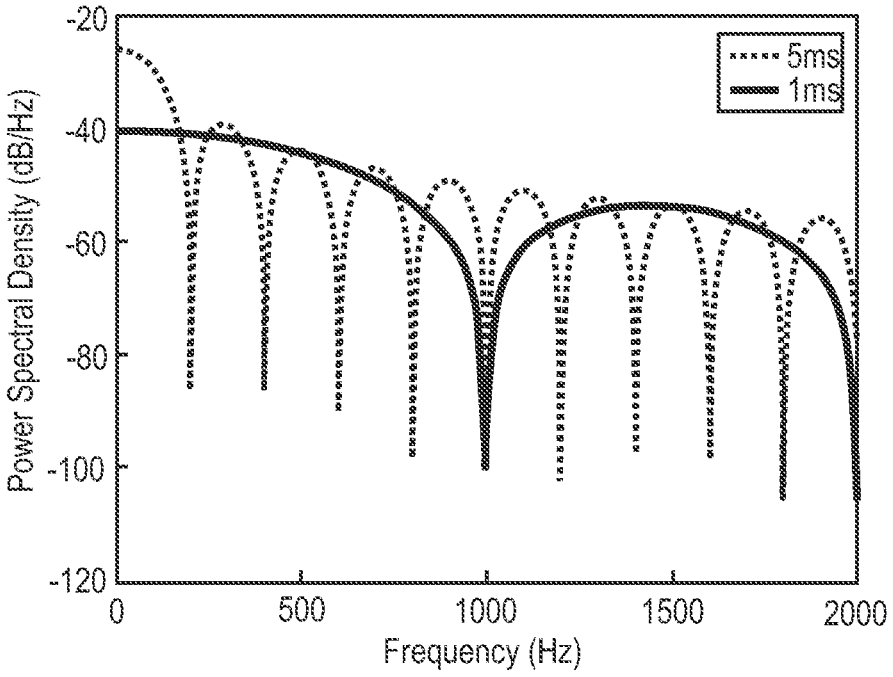
FIG. 4B is a graph showing the frequency components correlating to the two rectangular pressure pulses shown in FIG. 4A.

FIG. 4B is a graph 402 showing the frequency components correlating to the two rectangular pressure pulses shown in FIG. 4A. The graph 402 shows that the frequency components of the high-frequency tube waves are determined by the total duration of each pressure pulse, i.e., the predetermined amount of time for opening and closing the one or more high-speed, actuated valves. In general, pressure pulses of shorter durations correspond to tube waves with broader spectrums of high-frequency components.

Figure 5A:
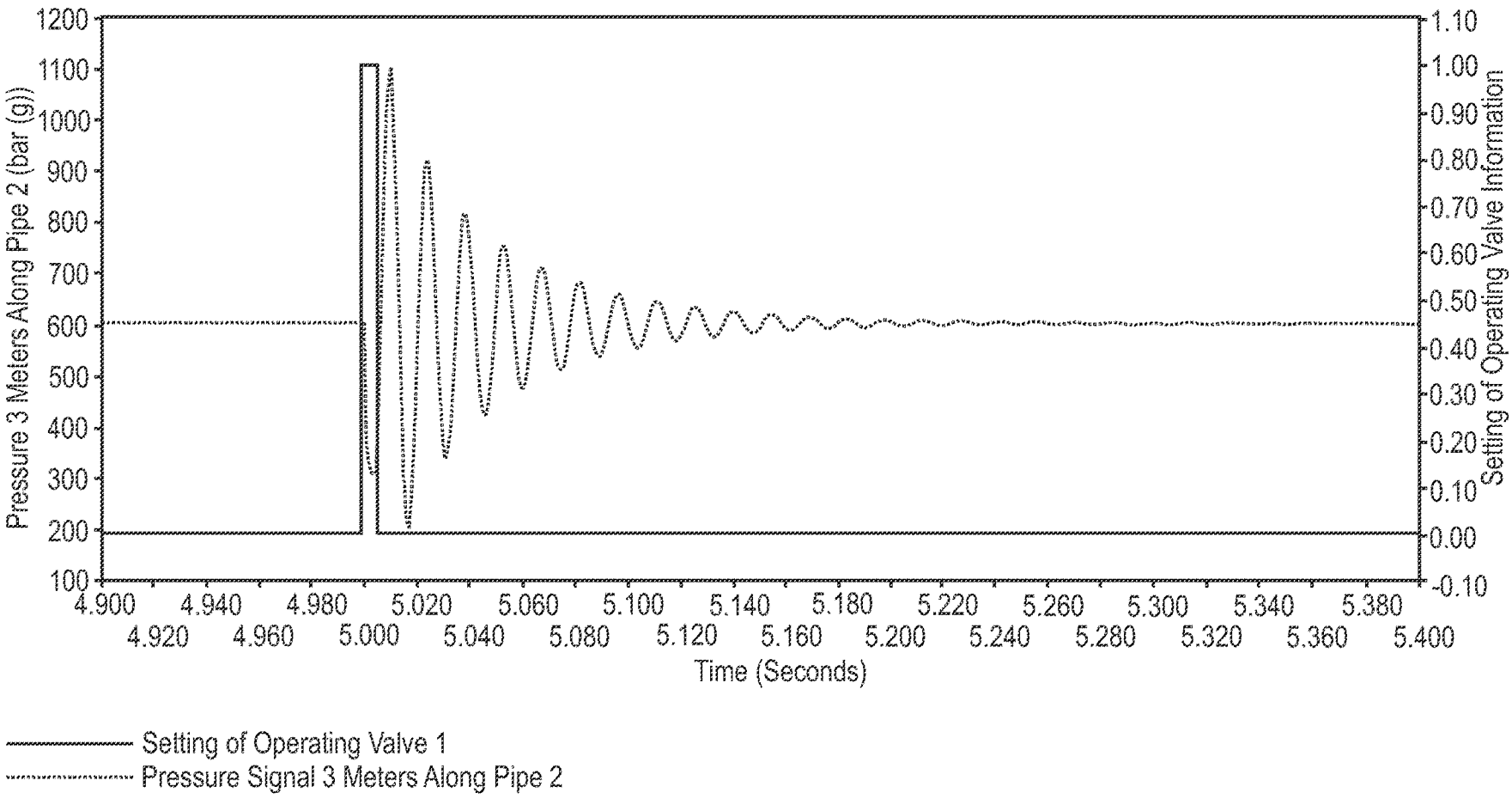
FIG. 5A is a graph showing a computed example of the manner in which coupling the one or more high-speed, actuated valves to the wellhead can significantly alter the shape of the resulting pressure pulse.
Figure 5B:
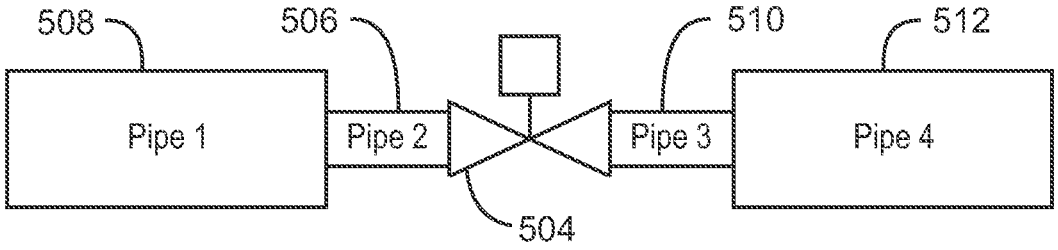
FIG. 5B is a schematic showing the lab setup for the computed example.

FIG. 5A is a graph 500 showing a computed example of the manner in which coupling the one or more high-speed, actuated valves to the wellhead can significantly alter the shape of the resulting pressure pulse. FIG. 5B is a schematic showing the lab setup 502 for the computed example. For this computed example, an operating valve 504 with a valve coefficient (Cv) of 100,000 liters/minute $Bar^{1/2}$ was attached to the end of a steel tubing, referred to as "Pipe 2," 506 that was 5 meters long and had an inner diameter of 10 millimeters (mm) and an outer diameter of 14 mm. Pipe 2 506 was connected to a pressurized steel tubing, referred to as "Pipe 1," 508 that was 4,000 meters long and had an inner diameter of 500 mm and an outer diameter of 800 mm. In this computed example, Pipe 1 508 represents the wellbore 102. The other end of the operating valve 504 was attached to the end of another steel tubing, referred to as "Pipe 3," 510 that was 5 meters long and had an inner diameter of 10 mm and an outer diameter of 14 mm. Pipe 3 510 was connected to a steel tubing, referred to as "Pipe 4," 512 that was 500 meters long and had an inner diameter of 500 mm and an outer diameter of 800 mm. The initial pressure in Pipes 1 and 2 508 and 506 was 600 bar, and the initial pressure in Pipes 3 and 4 510 and 512 was 1 bar. Therefore, when the operating valve 504 was opened, the pressurized fluid naturally flowed from the higher-pressure end to the lower-pressure end, i.e., from Pipes 1 and 2 to Pipes 3 and 4, thus generating a pressure pulse within the system. More specifically, the pressurized fluid rushed from the longer Pipe 1 508 to the shorter Pipe 4 512, and then began oscillating between both ends of Pipe 4 512 until pressure equilibrium was reached. The oscillation frequency was dependent on the length of Pipe 4 512, as well as the sound speed within the fluid inside Pipe 4 512. This oscillating pressure pulse was then measured, as show in the graph 500.

The graph 500 shows the timing for setting the operating valve 504 to generate a rectangular pressure pulse with a duration of 5 milliseconds, as well as the gauge pressure (bar(g)) of the resulting pressure signal 3 meters along Pipe 2 508. The significant distortion of the pressure signal is caused by reflection points at the end of Pipe 1 506. This computed example shows that closely-coupling the high-speed, actuated valves described herein to the wellbore may help to preserve the desired spectral shape of the resulting tube waves. Therefore, in some embodiments, the distance between the center of the wellhead and the high-speed, actuated valve on the tubing may be less than 50 feet, less than 20 feet, less than 5 feet, or less than 1 foot, depending on the details of the specific implementation.

Figure 6A:
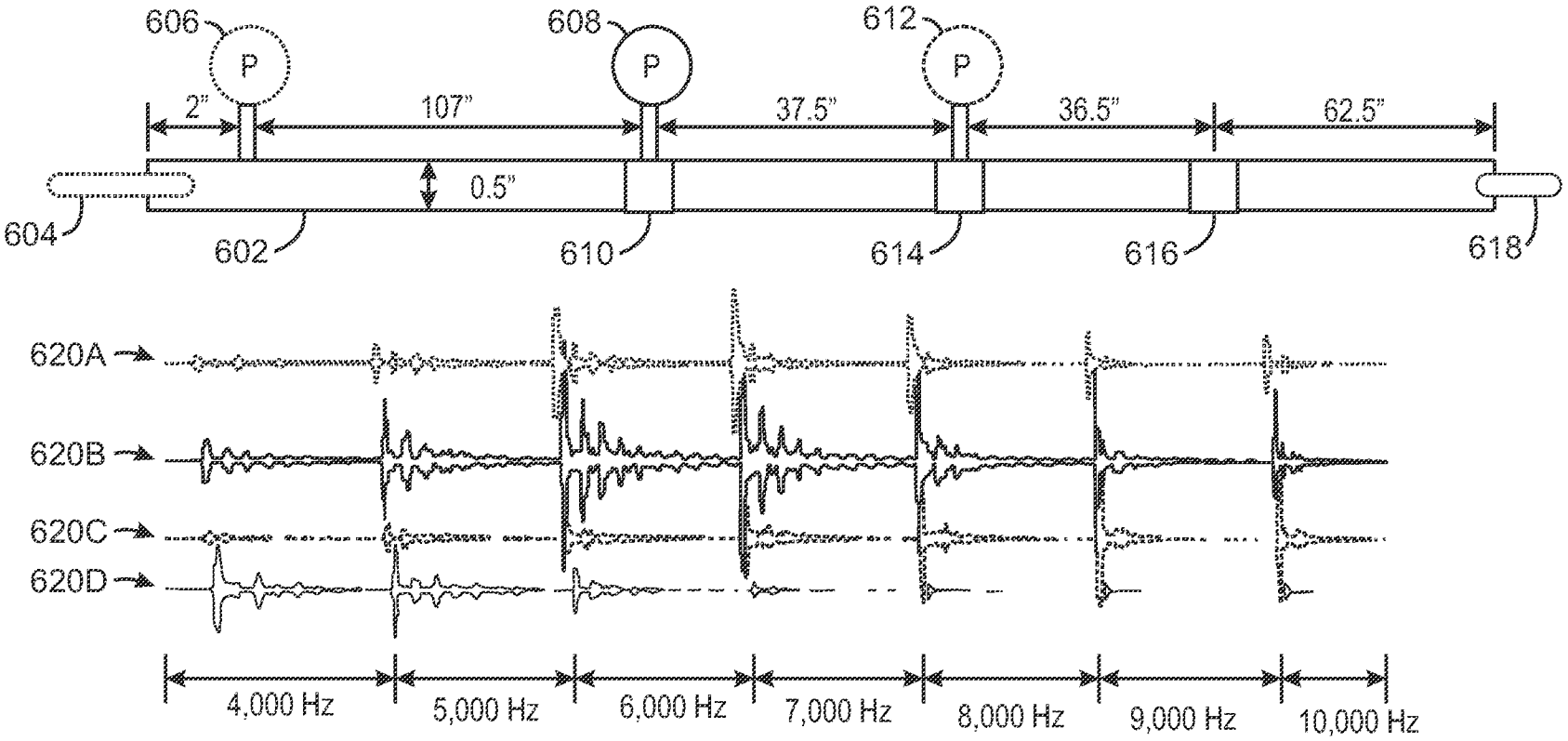
FIG. 6A is a graph showing pressure pulse results from a lab test including a configuration of components that simulate reflectors within a wellbore.

FIG. 6A is a graph 600 showing pressure pulse results from a lab test including a configuration of components that simulate reflectors within a wellbore. Specifically, the lab test was conducted using a water-filled tubing 602 with a 0.5-inch inner diameter. The tubing 602 included a first hydrophone 604 at one end, a first pressure gauge 606 located proximate to the first hydrophone 604, a second pressure gauge 608 positioned proximate to a first T-joint 610, a third pressure gauge 612 positioned proximate to a second T-joint 614, a coupling joint 616, and a second hydrophone 618 at the other end.

During the simulation, individual pressure signals with frequencies of 4,000 Hz, 5,000 Hz, 6,000 Hz, 7,000 Hz, 8,000 Hz, 9,000 Hz, and 10,000 Hz were propagated through the tubing 602, beginning at the location of the first hydrophone 604. In this particular lab test, the individual pressure signals were Hanning windowed 5-cycle sinusoidal waveforms with narrow frequency components. Using this type of waveform with a pure frequency component helps to avoid distortion of the waveform due to frequency-dependent attenuation and dispersion.

The individual pressure signals were then recorded at different pressure receivers. Specifically, a first set of pressure readings 620A was recorded by the first pressure gauge 606, a second set of pressure readings 620B was recorded by the second pressure gauge 608, a third set of pressure readings 620C was recorded by the third pressure gauge 612, and a fourth set of pressure readings 620D was recorded by the second hydrophone 618. The pressure readings 620A-D reveal that the quality of each pressure signal is frequency dependent due to the localized resonating effects from the T-joints 610 and 614, which may be analogized to different fracture networks within a wellbore, and the coupling joint 616, which may be analogized to a casing joint within the wellbore.

Figure 6B:
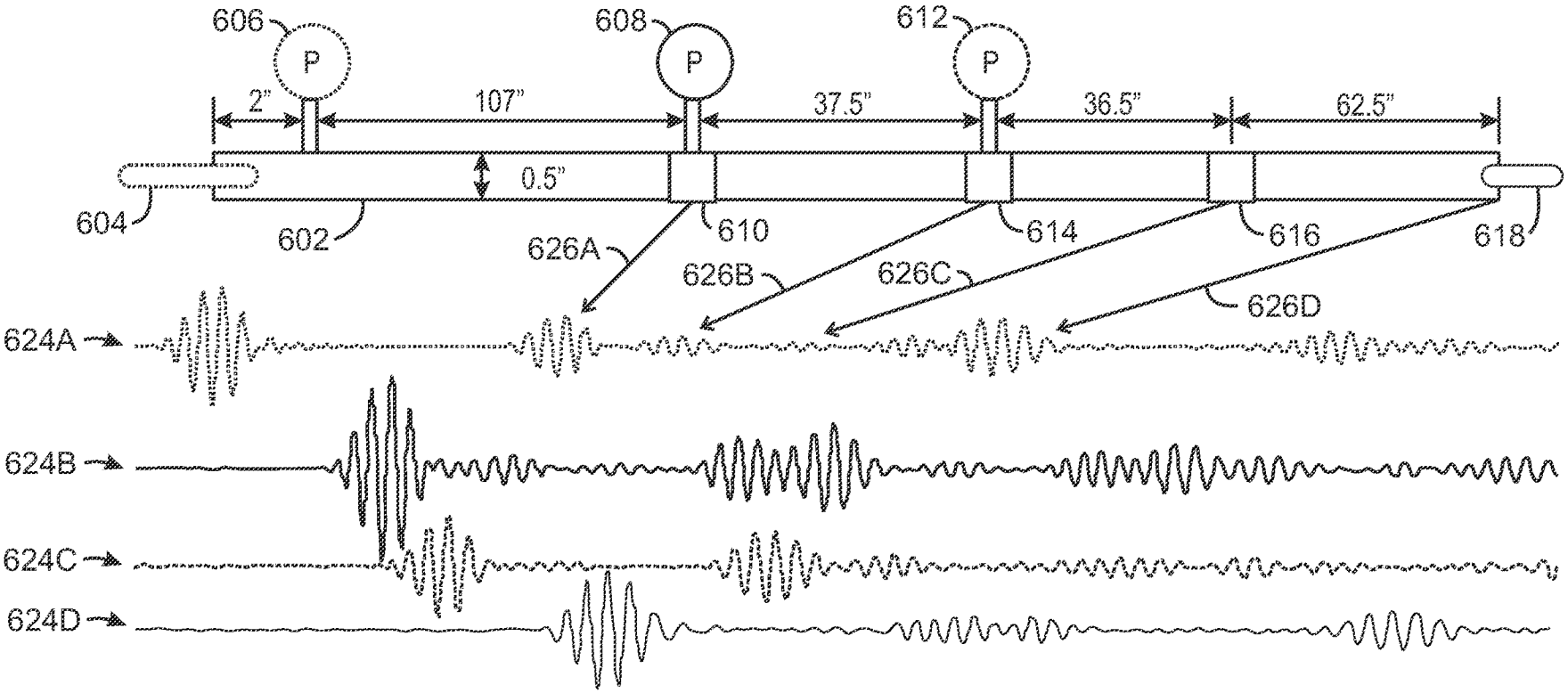
FIG. 6B is a graph showing pressure pulse results for the same lab test using only the pressure signal with the frequency of 4,000 Hz.

FIG. 6B is a graph 622 showing pressure pulse results for the same lab test using only the pressure signal with the frequency of 4,000 Hz. A first pressure reading 624A was measured by the first pressure gauge 606, a second pressure reading 624B was measured by the second pressure gauge 608, a third pressure reading 624C was measured by the third pressure gauge 612, and a fourth pressure reading 624D was measured by the second hydrophone 618. The pressure readings 624A-D show that the reflectors, i.e., the T-joints 610 and 614 and the coupling joint 616, may be successfully identified using physical models that account for the time of flight and the sound speed within the tubing 602. Moreover, the pressure readings 624A-D show that reflectivity is a good indicator of the property of each reflector. As an example, the portion of the first pressure reading 624A relating to each reflector is indicated by arrows 626A-D.

Figure 7A:
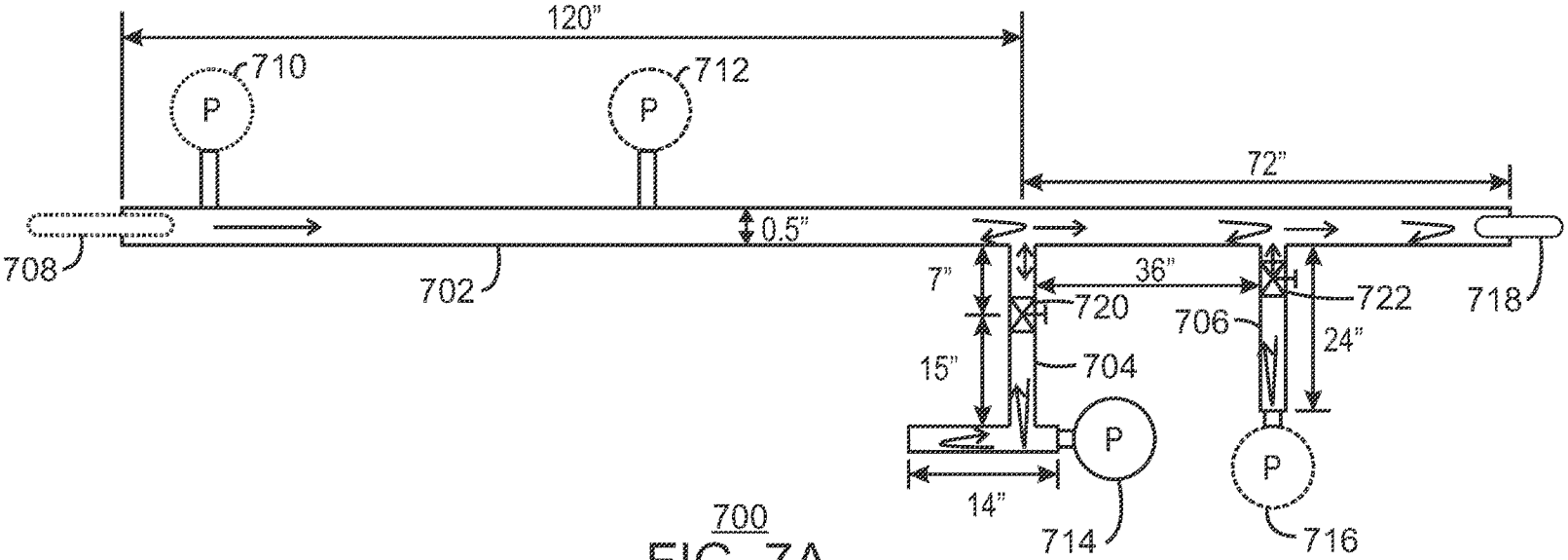
FIG. 7A is schematic of a lab setup for tracing a pressure wave response in a pipe including two branches, which mimic two fractures at different locations along a wellbore.

FIG. 7A is schematic of a lab setup 700 for tracing a pressure wave response in a pipe 702 including two branches 704 and 706, which mimic two fractures at different locations along a wellbore. The pipe 702 includes a first hydrophone 708 and a first pressure gauge 710 positioned at the one end, a second pressure gauge 712 optionally positioned around the middle of the pipe 702, a third pressure gauge 714 positioned at the end of the first branch 704, a fourth pressure gauge 716 positioned at the end of the second branch 706, and a second hydrophone 718 positioned at the other end of the pipe 702. In addition, the pipe 702 includes a first valve 720 positioned at the entrance of the first branch 704 and a second valve 722 positioned at the entrance of the second branch 706.

Figure 7B:
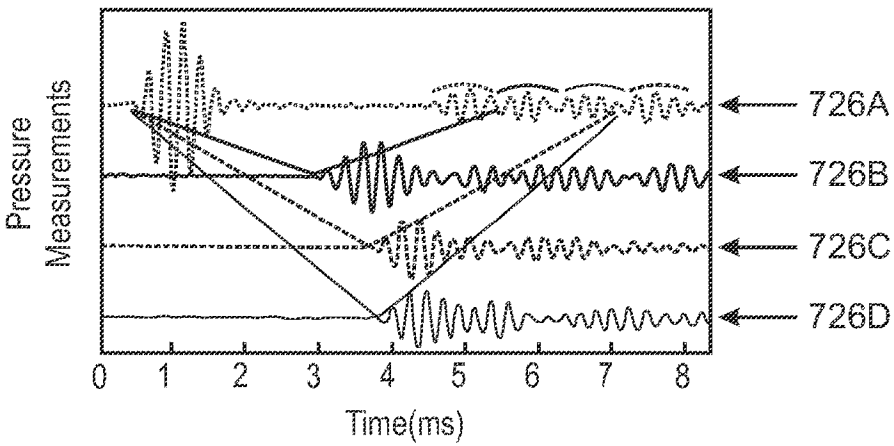
FIG. 7B is a graph showing the pressure signals recorded by the individual pressure receivers shown in the lab setup of FIG. 7A.

During the lab test, a pressure pulse was propagated through the pipe 702, beginning at the location of the first hydrophone 708. FIG. 7B is a graph 724 showing the pressure signals recorded by the individual pressure receivers shown in the lab setup 700 of FIG. 7A. Specifically, a first set of pressure readings 726A was recorded by the first pressure gauge 710, a second set of pressure readings 726B was recorded by the third pressure gauge 714, a third set of pressure readings 726C was recorded by the fourth pressure gauge 716, and a fourth set of pressure readings 726D was recorded by the second hydrophone 718. The recorded pressure signals reveal the manner in which the T-joints and branch terminations along the pipe 702 act as reflection points for the pressure pulse.

Figure 8A:
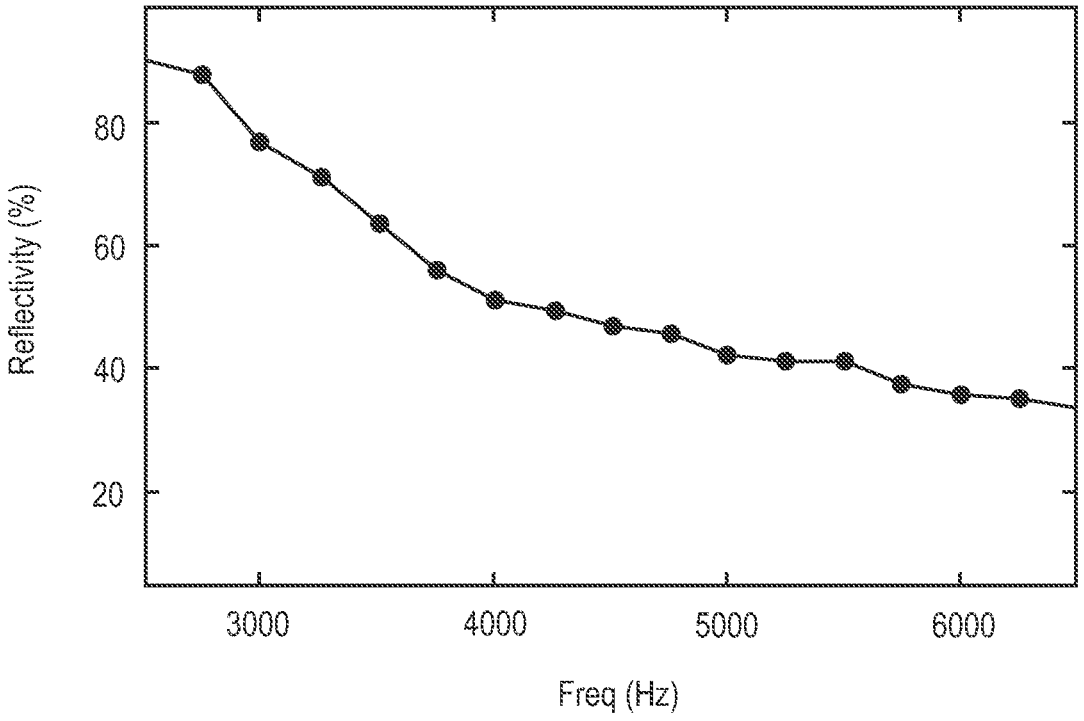
FIG. 8A is a graph showing the results of lab measurements in which reflectivity is measured as a function of frequency.
Figure 8B:
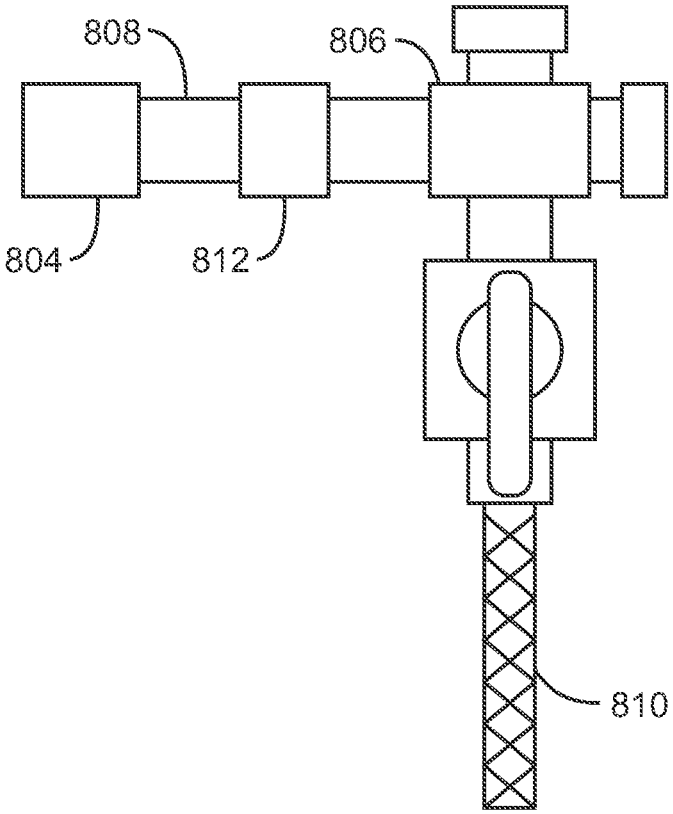
FIG. 8B is a schematic of the lab setup that was used to conduct the lab measurements shown in FIG. 8A.

FIG. 8A is a graph 800 showing the results of lab measurements in which reflectivity is measured as a function of frequency. FIG. 8B is a schematic of the lab setup 802 that was used to conduct the lab measurements shown in FIG. 8A. Specifically, the lab measurements were conducted by generating tube waves using a source 804 attached to a joint 806 through a pipe 808. The generated tube waves were propagated through the pipe 808, the joint 806, and a plastic tube 810 attached to the joint 806. In various embodiments, the pipe 808 was analogous to the wellbore, the plastic tube 810 was analogous to a fracture extending from the wellbore, and the joint 806 was analogous to the interface between the wellbore and the fracture. A receiver 812 attached to the pipe 808 between the source 804 and the joint 806 was then used to record the measurements corresponding to the tube waves. As revealed by the graph 800, higher frequency tube waves have a correspondingly lower reflectivity.

In operation, the reflectivity of a tube wave as it interacts with a fracture is based on the acoustic impedance boundary between the wellbore and the fracture, which is determined by a number of factors, such as the size of the fracture entrance, the near-wellbore tortuosity of the fracture, and the fracture compliance, for example. According to current fracture diagnostic techniques, reflectivity limitations imposed by such acoustic impedance boundaries often result in the detection of only the first few fractures within a stage. However, because the fracture diagnostic technique described herein utilizes tube waves with a spectrum of high-frequency components, the tube waves have a lower reflectivity and, thus, travel much deeper, often detecting fractures corresponding to multiple perforation clusters for each stage.

Figure 9A:
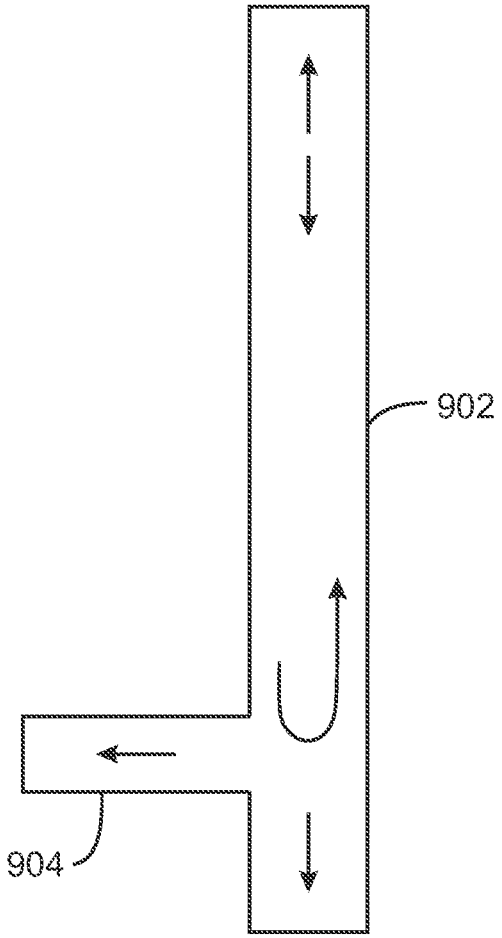
FIG. 9A is a schematic showing a simulated setup for determining how the inner diameter of a fracture opening and the sound speed within the fracture affect the reflectivity of a pressure wave.

FIG. 9A is a schematic showing a simulated setup 900 for determining how the inner diameter of a fracture opening and the sound speed within the fracture affect the reflectivity of a pressure wave. The simulated setup 900 includes a main pipe 902 that represents a wellbore and another pipe 904 that represents a fracture cluster opening. The inner diameter of the pipe 904 may be altered throughout the simulation to measure how the inner diameter of the pipe 904 affects the reflectivity of the pressure wave propagating through the main pipe 902.

Figure 9B:
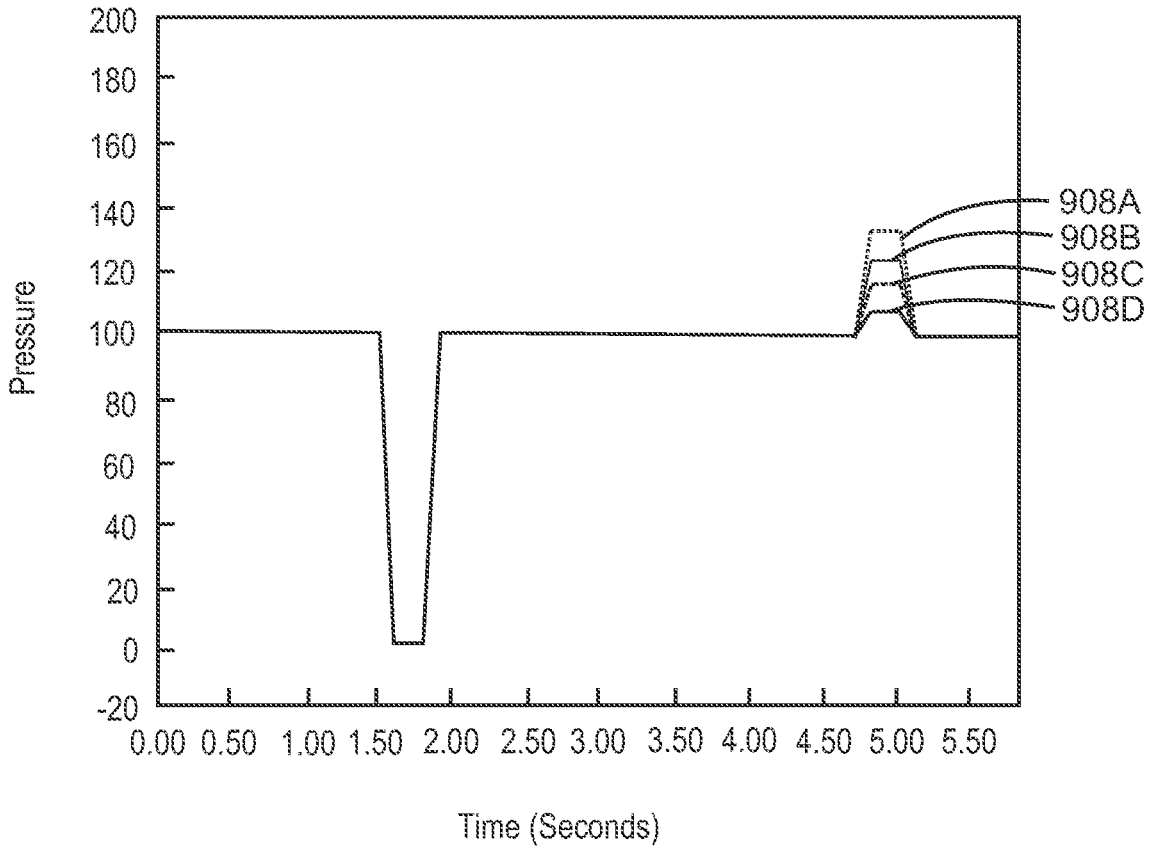
FIG. 9B is a graph showing pressure readings corresponding to the simulation conducted using pipes of different diameters according to the simulated setup shown in FIG. 9A.

FIG. 9B is a graph 906 showing pressure readings corresponding to the simulation conducted using pipes 904 of different diameters according to the simulated setup 900 shown in FIG. 9A. Specifically, a first pressure reading 908A corresponds to an inner diameter of 7.2 inches for the pipe 904, a second pressure reading 908B corresponds to an inner diameter of 10.8 inches for the pipe 904, a third pressure reading 908C corresponds to an inner diameter of 13.6 inches for the pipe 904, and a fourth pressure reading 908D corresponds to an inner diameter of 17 inches for the pipe 904. These pressure readings were taken using a fixed sound speed of 1,500 meters/second (m/s).

Figure 9C:
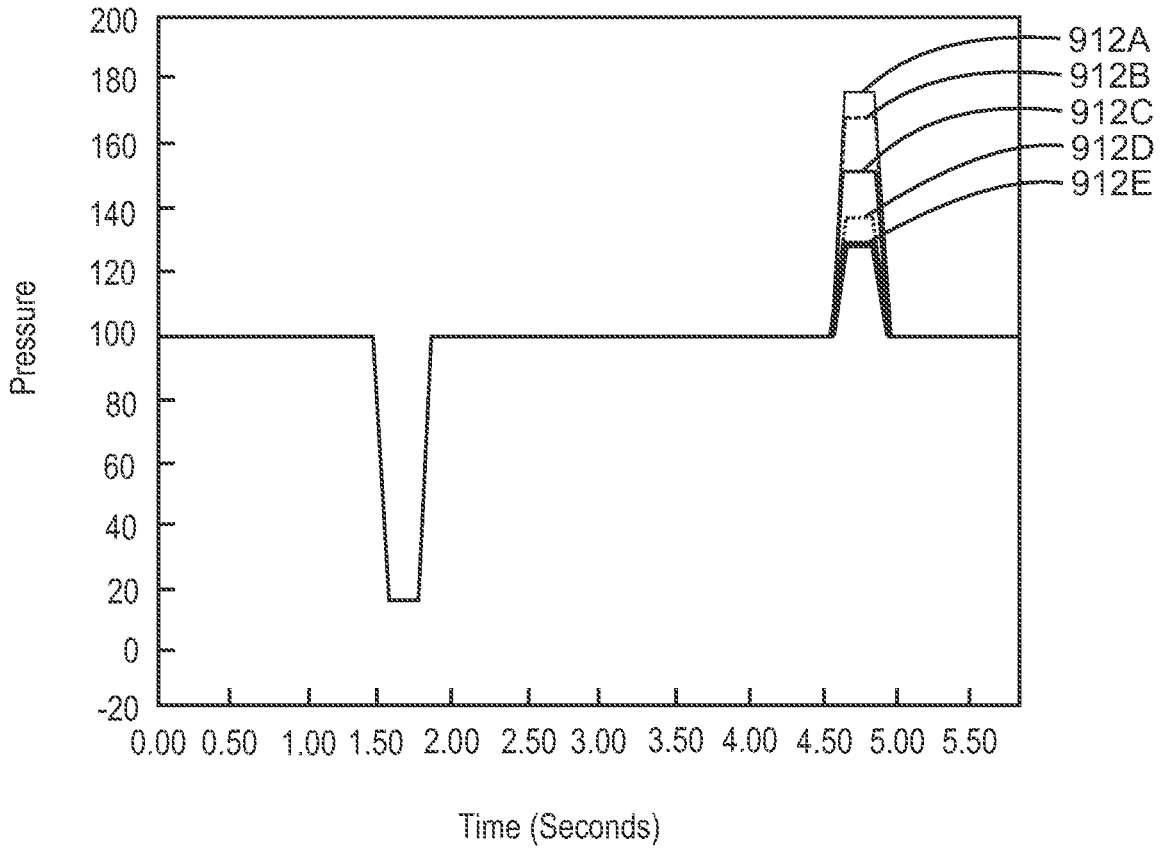
FIG. 9C is a graph showing pressure readings corresponding to different sound speeds within the pipe shown in FIG. 9A.

FIG. 9C is a graph 910 showing pressure readings corresponding to different sound speeds within the pipe 904 shown in FIG. 9A. Specifically, a first pressure reading 912A corresponds to a sound speed of 100 m/s within the pipe 904, a second pressure reading 912B corresponds to a sound speed of 200 m/s within the pipe 904, a third pressure reading 912C corresponds to a sound speed of 500 m/s within the pipe 904, a fourth pressure reading 912D corresponds to a sound speed of 1,000 m/s within the pipe 904, and a fifth pressure reading 912E corresponds to a sound speed of 1,500 m/s within the pipe 904. These pressure readings were taken using a fixed inner diameter of 17 inches for the pipe 904.

Figure 9D:
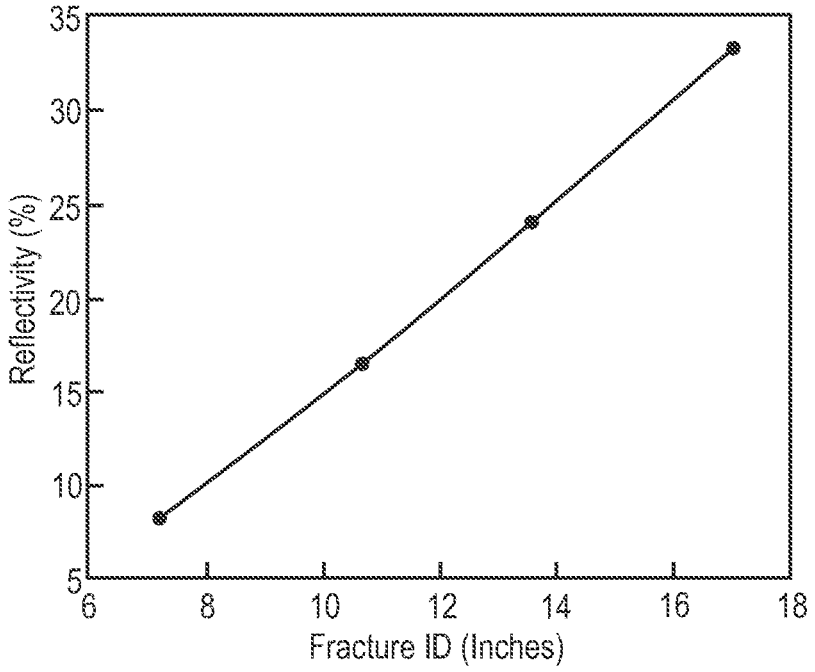
FIG. 9D is a graph summarizing the results of FIG. 9B, which show reflectivity as a function of the inner diameter of the pipe shown in FIG. 9A.

FIG. 9D is a graph 914 summarizing the results of FIG. 9B, which show reflectivity as a function of the inner diameter of the pipe 904 shown in FIG. 9A. The graph 914 reveals that the reflectivity of a pressure wave is dependent on the inner diameter of a fracture cluster opening. Specifically, the larger the diameter, the larger the reflection.

Figure 9E:
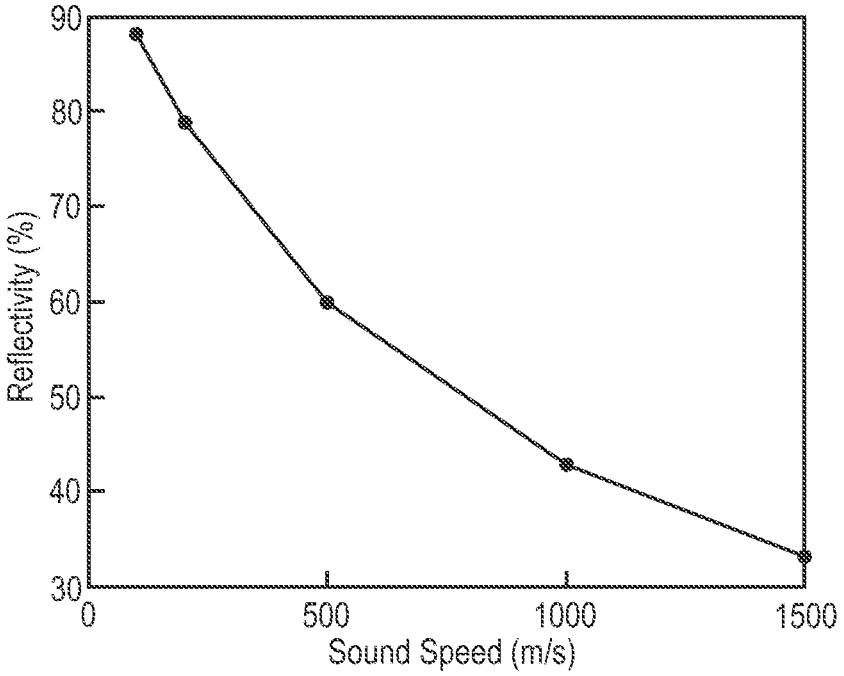
FIG. 9E is a graph summarizing the results from FIG. 9C, which show reflectivity as a function of sound speed within the pipe shown in FIG. 9A.

FIG. 9E is a graph 916 summarizing the results from FIG. 9C, which show reflectivity as a function of sound speed within the pipe 904 shown in FIG. 9A. The graph 916 reveals that the reflectivity of a pressure wave is also dependent on the sound speed within a fracture cluster. Specifically, the higher the sound speed, the smaller the reflection.

Figure 10A:
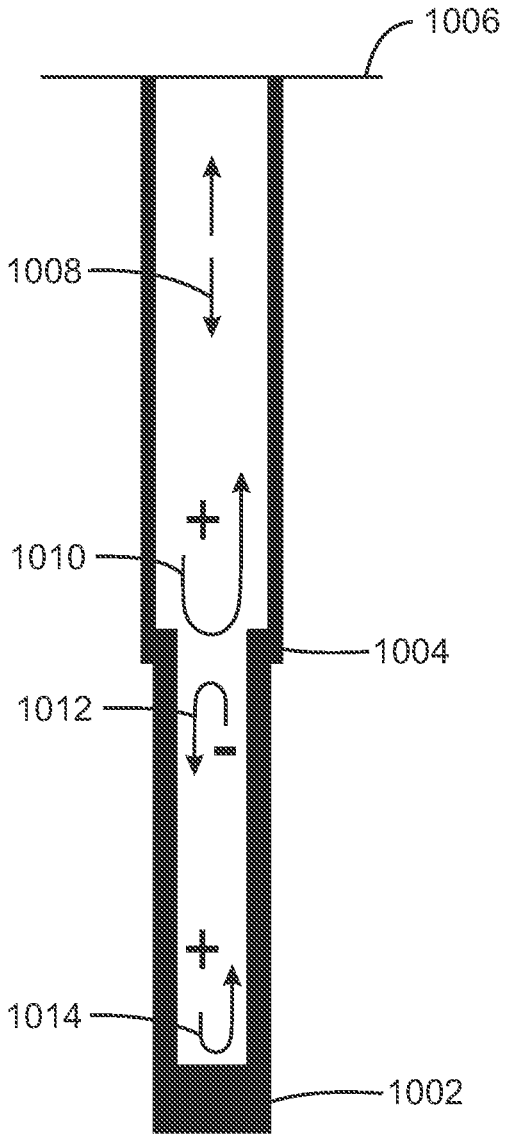
FIG. 10A is a simplified schematic of a wellbore simulation with a top plug and a liner hanger that was used for pressure wave measurements.

FIG. 10A is a simplified schematic of a wellbore simulation 1000 with a top plug 1002 and a liner hanger 1004 that was used for pressure wave measurements. In the wellbore simulation 1000, the liner hanger 1004 that was located approximately 10,445 feet away from a surface 1006. The top plug 1002 was located at two different depths. Specifically, the top plug was either located 964 feet away from the liner hanger 1004 or 1,464 feet away from the liner hanger 1004. As shown in FIG. 10A, a pressure wave 1008 traveling down the wellbore had a positive reflection 1010 from the liner hanger 1004 as the pressure wave 1008 traveled down the wellbore and a negative reflection 1012 from the liner hanger 1004 as the pressure wave 1008 traveled back toward the surface 1006. In addition, the pressure wave 1008 had a positive reflection 1014 from the top plug 1002.

Because the top plug 1002 was the last reflector after the liner hanger 1004, the top plug's location could be identified with its reflection in time. Moreover, the plug reflection would be shadowed if the top plug 1002 was close to a fracture and the pressure pulse was wide.

Figure 10B:
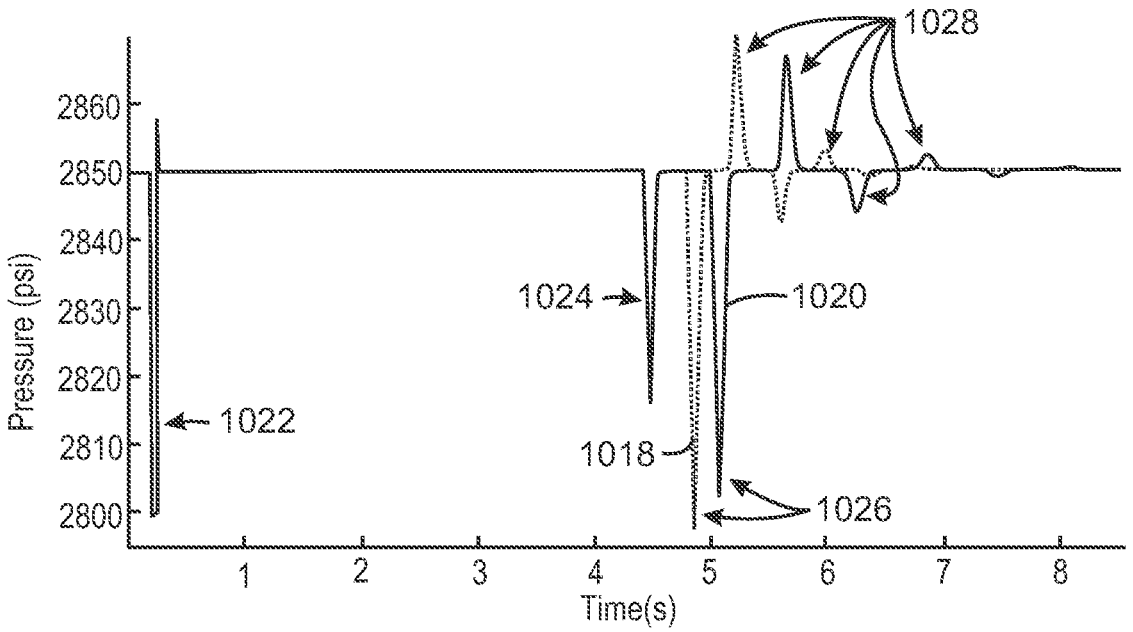
FIG. 10B is a graph showing pressure readings that were obtained using the wellbore simulation shown in FIG. 10A.

FIG. 10B is a graph 1016 showing pressure readings that were obtained using the wellbore simulation 1000 shown in FIG. 10A. A first pressure reading 1018 was obtained using a top plug depth of 964 feet from the liner hanger 1004, while a second pressure reading 1020 was obtained using a top plug depth of 1,464 feet from the liner hanger 1004. The pressure readings show an initial pressure drop at the surface 1006, as indicated by arrow 1022, as well as a primary reflection from the liner hanger 1004, as indicated by arrow 1024. The pressure readings also show the primary reflections from the top plug 1002 at each top plug depth, as indicated by arrows 1026. All the reflections after that point in time, which are indicated by arrows 1028, were caused by internal negative reflections between the liner hanger 1004 and the top plug 1002.

Figure 11A:
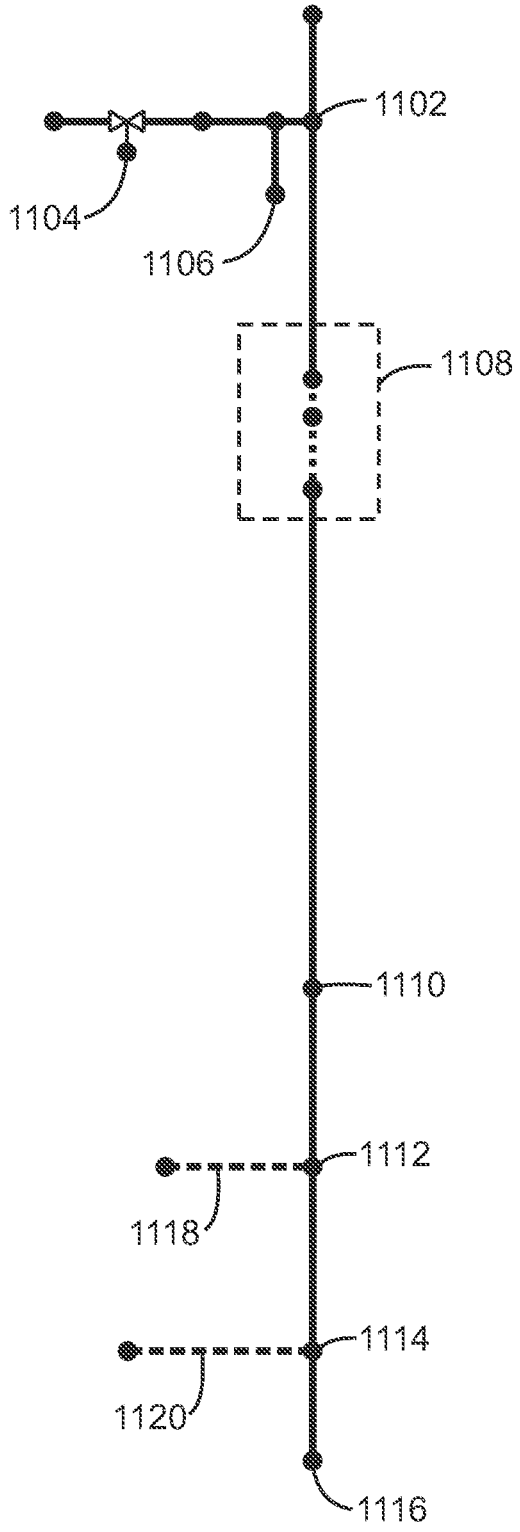
FIG. 11A is a simplified schematic of a wellbore simulation including a number of different types of reflectors that was used for pressure wave measurements.

FIG. 11A is a simplified schematic of a wellbore simulation 1100 including a number of different types of reflectors that was used for pressure wave measurements. The wellbore simulation 1100 included a wellhead 1102 at the surface with an attached pressure-relief valve 1104 that acted as a high-frequency tube wave generator and a pressure transducer 1106 that acted as a high-frequency, high-sensitivity pressure receiver. Within the wellbore, there were a number of artificial reflectors 1108 that mimicked field data. The artificial reflectors 1108 could be, for example, surface valves or joints connecting pipes and/or casings of different sizes. In addition, there was a liner hanger 1110 positioned approximately 10,443 feet from the surface, a top perforation cluster 1112 located approximately 11,293 feet from the surface, a second perforation cluster 1114 located approximately 11,373 feet from the surface, and a top frac plug 1116 positioned approximately 11,407 feet from the surface. A fracture cluster 1118 extending from the top perforation cluster 1112 was approximately 300 feet long, while a fracture cluster 1120 extending from the second perforation cluster 1114 was approximately 200 feet long.

Figure 11B:
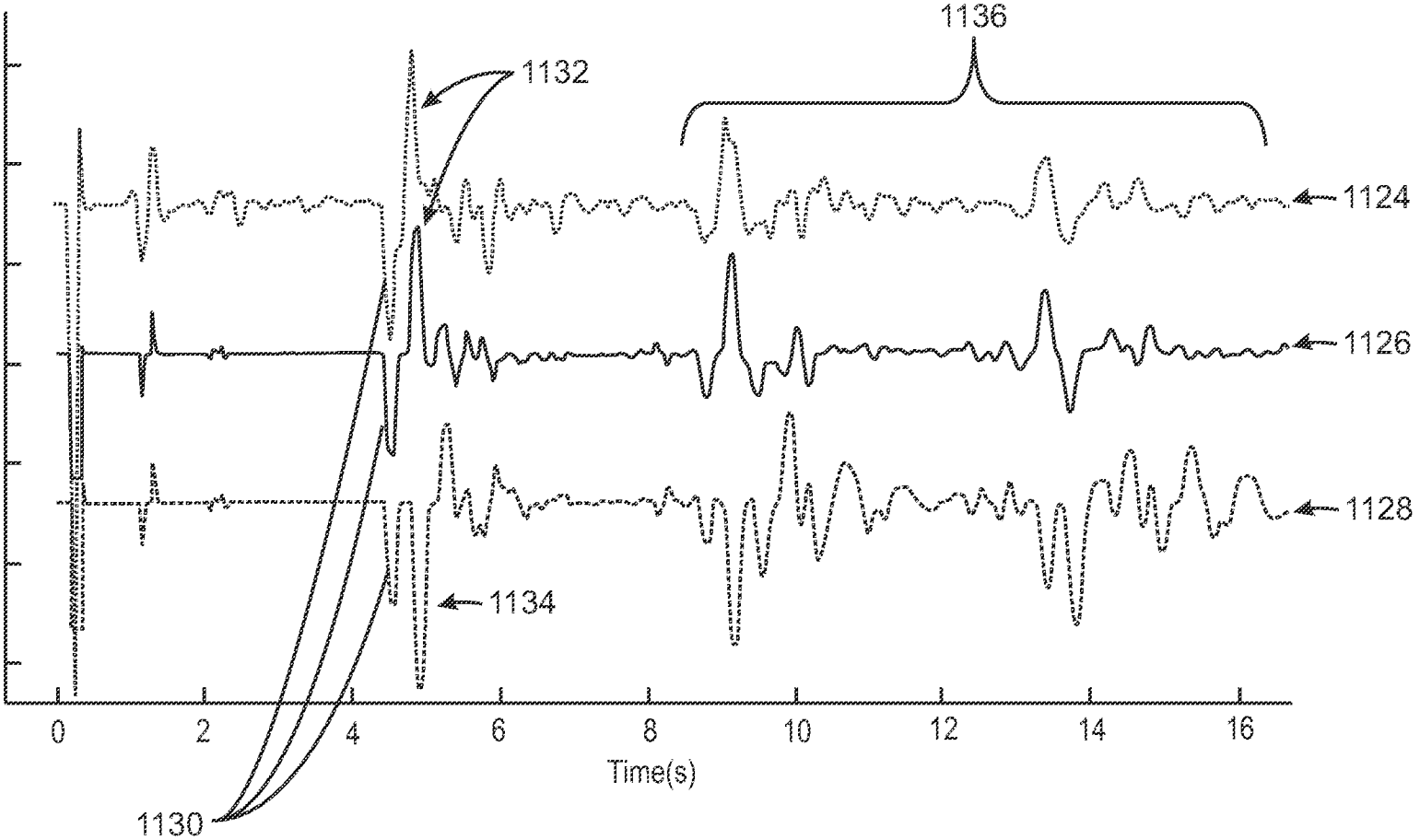
FIG. 11B is a graph showing pressure readings that were obtained using field data, as well as pressure readings that were obtained using the wellbore simulation with and without the fracture clusters included.

FIG. 11B is a graph 1122 showing pressure readings that were obtained using field data, as well as pressure readings that were obtained using the wellbore simulation 1100 with and without the fracture clusters 1118 and 1120 included. Specifically, a first pressure reading 1124 was obtained using field data, a second pressure reading 1126 was obtained using simulation data with the fracture clusters 1118 and 1120 included within the wellbore simulation 1100, and a third pressure reading 1128 was obtained using simulation data without the fracture clusters 1118 and 1120 included within the wellbore simulation 1100. Each pressure reading 1124, 1126, and 1128 included a reflection from the liner hanger 1110, as indicated by arrows 1130. In addition, the first two pressure readings 1124 and 1126 included reflections from the fracture clusters 1118 and 1120, as indicated by arrows 1132, while the third pressure reading 1128 included a reflection from the top frac plug 1116, as indicated by arrow 1134. Moreover, as indicated by the arrow 1136, all here pressure readings 1124, 1126, and 1128 included multiple back and forth reflections between the various reflectors within the wellbore. This wellbore simulation 1100 provides an example of how the high-frequency tube waves described herein can be used to identify the characteristics of different reflectors within a wellbore.

Figure 12:
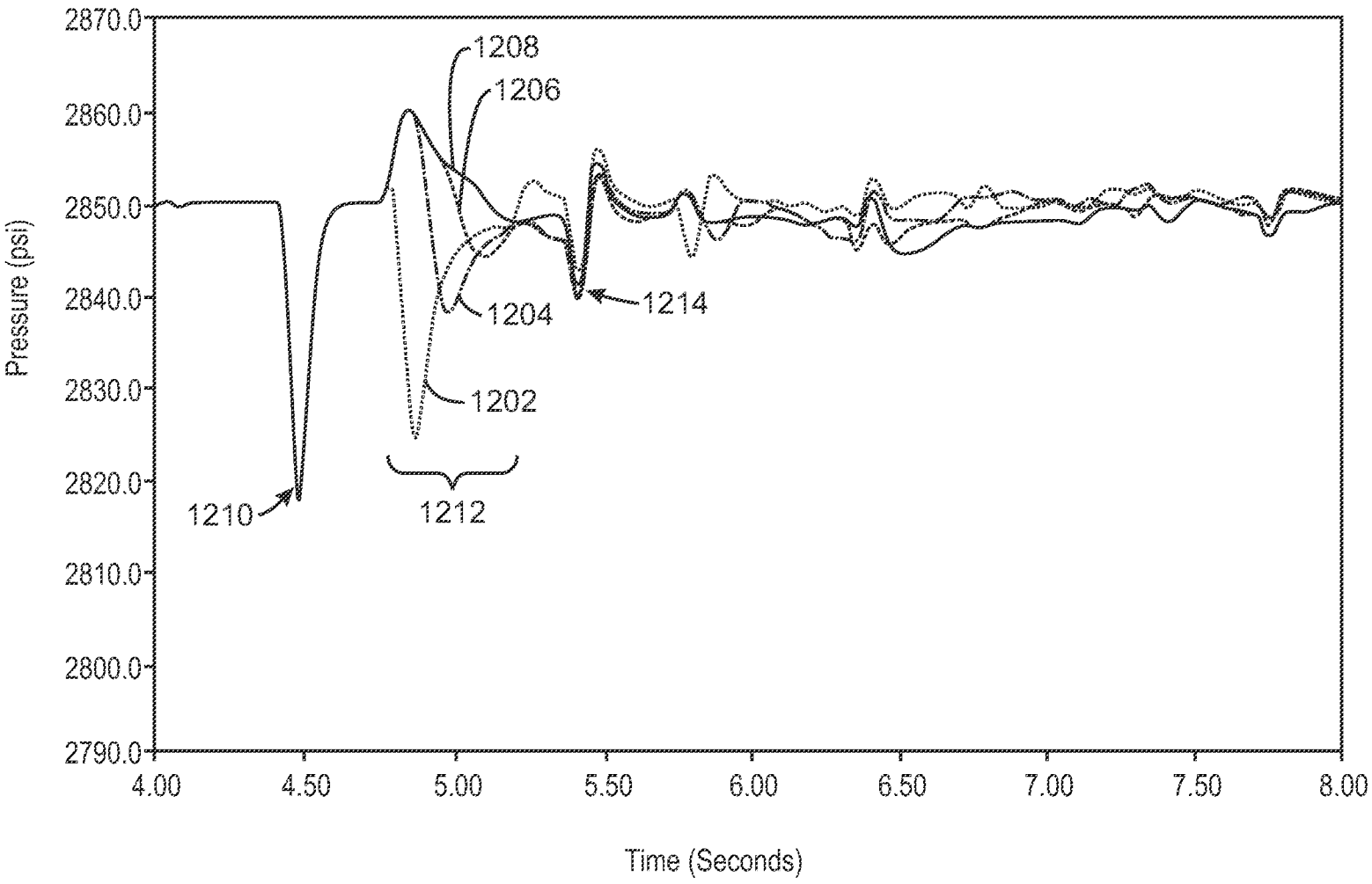
FIG. 12 is a graph showing simulation results of field measurements for cases that plug at different depths.

FIG. 12 is a graph 1200 showing simulation results of field measurements for cases that plug at different depths. The results show that using a narrower pressure pulse results in the detection of a larger number of fractures. The simulation was configured using a pressure pulse duration of 0.5 seconds. Each fracture was modeled as a 200 foot long pipe with an inner diameter of 0.5 inches and a sound speed of 100 feet/second. The simulation results include a first pressure reading 1202 at the top frac stage that shows two fractures, a second pressure reading 1204 at the next earlier stage (located 250 feet from the top frac stage) that includes an additional 3 fractures, i.e., a total of 5 fractures, a third pressure reading 1206 at the next earlier stage (located 500 feet from the top frac stage) that includes an additional 3 fractures, i.e., a total of 8 fractures, and a fourth pressure reading 1208 at the next earlier stage (located 750 feet from the top frac stage) that includes an additional 3 fractures, i.e., a total of 11 fractures. Furthermore, in the graph 1200, the reflection from the hanger is indicated by arrow 1210, the reflections from the fractures are indicated by arrow 1212, and the reflection from the artificial reflector is indicated by arrow 1214. As shown in the graph 1200, the reflections from the hanger and the artificial reflector are approximately the same for all four cases, while the reflections from the fractures differ for each case.

The graph 1200 reveals that the plug reflection is seen when the fractures are small and the pressure pulse is short. A larger number of fractures results in an increased reflected signal intensity, which plateaus at a fixed number of fractures, e.g., 5, 8, or 11 fractures. In addition, a larger number of fractures results in a broadened reflected pressure signal, due to superimpositions of reflections from fractures at deeper locations.

Method for Collecting Data Relating to Wellbore Characteristics

Figure 13:
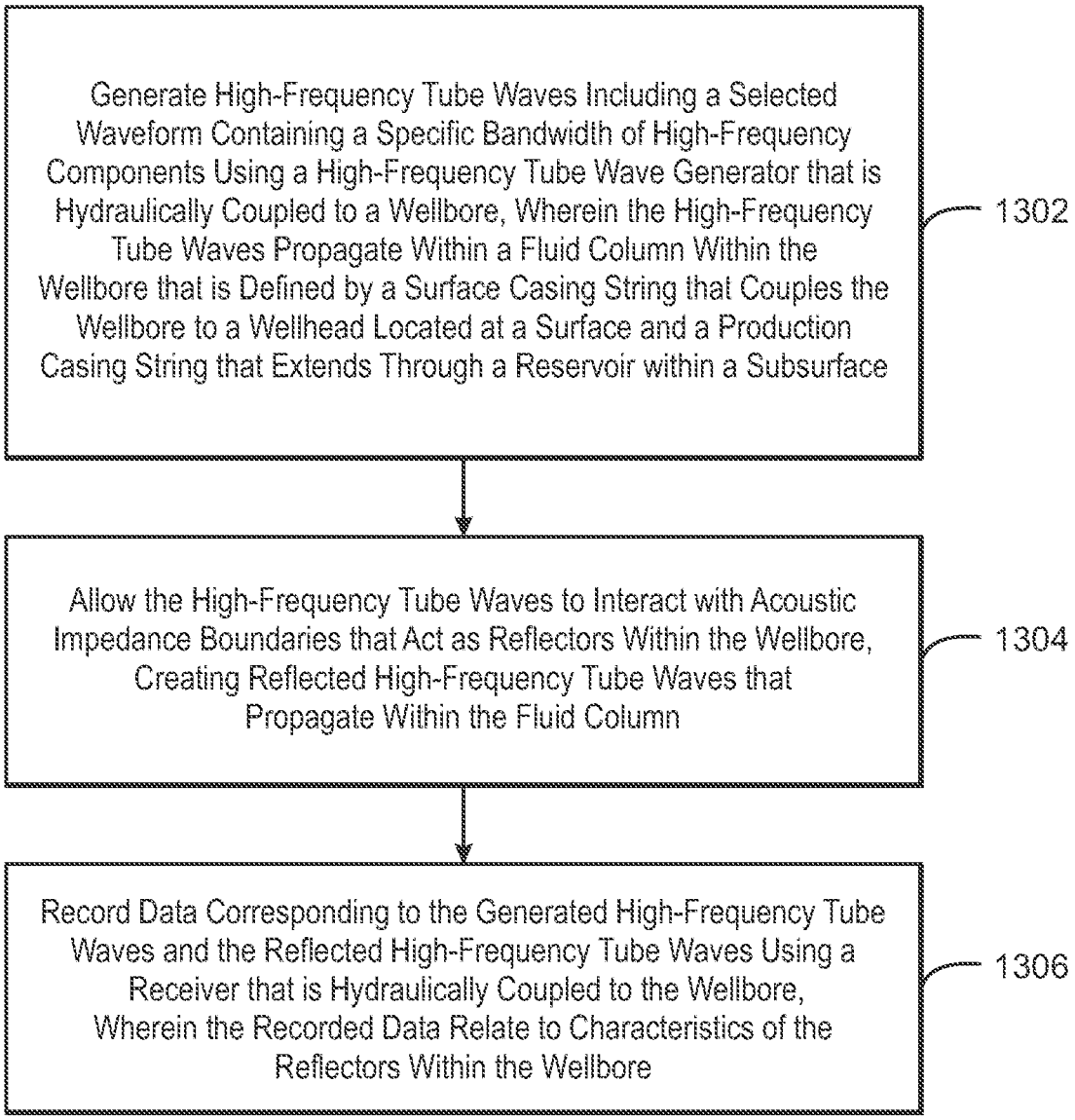
FIG. 13 is a process flow diagram of a method for collecting data relating to characteristics of a wellbore.

FIG. 13 is a process flow diagram of a method 1300 for collecting data relating to characteristics of a wellbore. The method 1300 begins at block 1302, at which high-frequency tube waves including a selected waveform containing a specific bandwidth of high-frequency components are generated using a high-frequency tube wave generator that is hydraulically coupled to a wellbore. The resulting high-frequency tube waves propagate within a fluid column within the wellbore that is defined by a surface casing string that couples the wellbore to a wellhead located at a surface and a production casing string that extends through a reservoir within a subsurface. In some embodiments, the high-frequency tube waves are generated by the high-frequency tube wave generator when the fluid column within the wellbore is static, flowing at a rate of less than 1 bbl/min, flowing at a rate of less than 5 bbl/min, or flowing at a rate of less than 10 bbl/min.

In some embodiments, the fluid column includes fracturing fluid that is present within the wellbore during a hydraulic fracturing process, and the production casing string includes a number of stages that are created during the hydraulic fracturing process, wherein each stage includes a number of perforation clusters and fractures corresponding to each perforation cluster. In such embodiments, the method 1300 may include generating the high-frequency tube waves after each stage is hydraulically fractured, and allowing the high-frequency tube waves to interact with acoustic impedance boundaries arising from interfaces between the wellbore and the fractures corresponding to each perforation cluster, wherein the data recorded by the receiver relates to characteristics of the fractures. Specifically, the recorded data may be relate to the number of perforation clusters for which fractures have formed, the sizes of the fractures corresponding to the perforation clusters for which fractures have formed, locations of the perforation clusters for which fractures have formed, or the number of perforation clusters that have been stimulated to at least a threshold level as measured by the characteristics of the fractures corresponding to the perforation clusters. In addition, the method 1300 may further include generating the high-frequency tube waves before each stage is hydraulically fractured, and using the data recorded by the receiver as a baseline pressure response for each stage.

In various embodiments, the high-frequency tube waves are generated using at least one high-speed, actuated valve that is electrically or hydraulically controlled. In such embodiments, the method 1300 may include using the at least one high-speed, actuated valve to create a pressure pulse of a predetermined duration, wherein a shorter duration corresponds to a larger bandwidth of high-frequency components. The predetermined duration may be between 1 millisecond and 10 milliseconds, for example. Moreover, in such embodiments, the method 1300 may also include using the at least one high-speed, actuated valve to create a pressure pulse of a predetermined shape. The predetermined shape may be a rectangular shape or a shape that corresponds to a waveform modulated with an envelope, such as a Hanning windowed or Ricker windowed sinusoidal waveform with a narrow frequency component.

In some embodiments, the fluid column within the wellbore is pressurized to a predetermined pressure level above ambient pressure, and then the high-frequency tube waves are generated by opening and closing the at least one high-speed, actuated valve in a highly-controllable, highly-repeatable manner to allow a portion of a fluid within the fluid column to bleed off to open air or a storage container. In other embodiments, the high-frequency tube waves are generated by opening and closing the at least one high-speed, actuated valve in a highly-controllable, highly-repeatable manner to inject a fluid into the fluid column within the wellbore. Furthermore, in some embodiments, the high-frequency tube waves are generated using a number of high-speed, actuated valves connected in parallel or in series, in which case the high-speed, actuated valves may be synchronized to open and close in a predetermined sequence and with a predetermined number of cycles to generate the high-frequency tube waves with a desired spectral shape.

In other embodiments, the high-frequency tube waves are generated via failure of one or more rupture disks and quick closure of one or more corresponding valves in a highly-controllable, highly-repeatable manner to allow a portion of a fluid within the fluid column to bleed off to a storage container. Moreover, in other embodiments, the high-frequency tube waves are generated by firing a perforating gun positioned within the production casing string. In other embodiments, the high-frequency tube waves are generated via opening of a fast-acting valve to allow pressurized fluid within the fluid column to oscillate between an entrance and a tip of a short pipe that is hydraulically connected to the wellhead via the fast-acting valve. Furthermore, in other embodiments, the high-frequency tube waves are generated using an explosive shock pulse generator.

In some embodiments, generating the high-frequency tube waves including the selected waveform containing a specific bandwidth of high-frequency components includes generating multiple discrete high-frequency tube waves. Each discrete high-frequency tube wave includes a frequency range that is a predetermined increment of the specific bandwidth of high-frequency components. In addition, each discrete high-frequency tube wave is generated at a different time slot, with a time interval between each time slot being long enough to allow a previous high-frequency tube wave to fully attenuate.

In various embodiments, generating the high-frequency tube waves including the selected waveform includes generating the high-frequency tube waves with at least 10% of frequencies above 10 Hertz (Hz), at least 10% of frequencies above 100 Hz, or at least 10% of frequencies above 1,000 Hz. In addition, generating the high-frequency tube waves including the selected waveform may include generating the high-frequency tube waves with an upper frequency limit that is selected based on an expected attenuation of the high-frequency tube waves and a minimum wavelength that can be tolerated for the high-frequency tube waves. Moreover, the upper frequency limit may be selected such that the wavelength of each high-frequency tube wave is at least double or at least triple the diameter of the production casing string. Furthermore, in some embodiments, generating the high-frequency tube waves using the high-frequency tube wave generator includes using the high-frequency tube wave generator to control pressure amplitudes of the high-frequency tube waves such that acceptable signal-to-noise ratios are obtained even after attenuation of the high-frequency tube waves within the wellbore.

At block 1304, the high-frequency tube waves are allowed to interact with acoustic impedance boundaries that act as reflectors within the wellbore, creating reflected high-frequency tube waves that propagate within the fluid column. In various embodiments, the acoustic impedance boundaries that act as reflectors include one or more casing joints, one or more liner hangers, one or more valves, one or more plugs, one or more sand bridges, or fractures corresponding to one or more perforation clusters within a particular stage of the hydrocarbon well.

At block 1306, data corresponding to the generated high-frequency tube waves and the reflected high-frequency tube waves are recorded using a receiver, such as a high-frequency, high-sensitivity pressure receiver, that is hydraulically coupled to the wellbore, wherein the recorded data relate to characteristics of the reflectors within the wellbore. In some embodiments, this involves using the receiver to resolve pressures that are a part in one thousand, a part in ten thousand, or a part in one hundred thousand of the maximum pressure amplitude of the high-frequency tube waves. In addition, in some embodiments, this involves using the receiver to record the data for a recording duration that is determined based on a length of the wellbore.

In various embodiments, the data corresponding to the generated and reflected high-frequency tube waves are recorded using at least one of one or more highly-sensitive pressure transducers directly connected to the wellhead or one or more highly-sensitive pressure transducers located within the wellbore. In some embodiments, this includes providing a highly-sensitive pressure transducer at least every 100 meters, at least every 10 meters, or at least every 1 meter along the casing strings within the wellbore. Moreover, in some embodiments, the positioning of the receiver and/or the high-frequency tube wave generator is modified based on the receiver's signal-to-noise ratio limit.

The process flow diagram of FIG. 13 is not intended to indicate that the steps of the method 1300 are to be executed in any particular order, or that all of the steps of the method 1300 are to be included in every case. Further, any number of additional steps not shown in FIG. 13 may be included within the method 1300, depending on the details of the specific implementation. For example, in some embodiments, the method 1300 also includes providing the receiver and the high-frequency tube wave generator at a predetermined minimum distance from each other to prevent interference between the high-frequency tubes propagating through the wellbore and the reflected tube waves returning from the wellbore.

In some embodiments, the method 1300 may be used to collect data relating to characteristics of a pipeline, rather than characteristics of a wellbore. Specifically, the method may include generating high-frequency tube waves including a selected waveform containing a specific bandwidth of high-frequency components using a high-frequency tube wave generator that is hydraulically coupled to a pipeline, wherein the high-frequency tube waves propagate within a fluid column within the pipeline. The method may also include allowing the high-frequency tube waves to interact with acoustic impedance boundaries that act as reflectors within the pipeline, creating reflected high-frequency tube waves that propagate within the fluid column. The method may further include recording data corresponding to the high-frequency tube waves and the reflected high-frequency tube waves using a receiver that is hydraulically coupled to the pipeline, wherein the recorded data relate to characteristics of the reflectors within the pipeline. In various embodiments, the reflectors include one or more elbows, one or more valves, one or more risers, one or more leakages, one or more blockages, one or more defects, and/or one or more other acoustic impedance boundaries within the pipeline.

In various embodiments, the pipeline is divided into a number of sections, and the method is performed for each section individually. This may provide increased accuracy as compared to performing the method for the entire pipeline at once, particularly when the pipeline is very long.

In some embodiments, the method also includes analyzing the recorded data to determine whether the reflectors include one or more leakages in the pipeline and, if so, analyzing the recorded data relating to the one or more leakages to determine a number of leakages, a location of each leakage, and/or a size of each leakage within the pipeline. The method may also include analyzing the recorded data to determine whether the reflectors include a blockage in the pipeline and, if so, analyzing the recorded data relating to the blockage to determine the location of the blockage. The method may also include analyzing the recorded data to determine whether the reflectors include one or more defects in the pipeline and, if so, analyzing the recorded data relating to the one or more defects to determine a number of defects, a type of each defect, a location of each defect, and/or a size of each defect within the pipeline.

While the embodiments described herein are well-calculated to achieve the advantages set forth, it will be appreciated that such embodiments are susceptible to modification, variation, and change without departing from the spirit thereof. Indeed, the present techniques include all alternatives, modifications, and equivalents falling within the true spirit and scope of the appended claims.

What is claimed is:

1. A hydrocarbon well, comprising:

a wellbore comprising a surface casing string that couples the wellbore to a wellhead located at a surface and a production casing string that extends through a reservoir within a subsurface, wherein a fluid column is present within the wellbore;

a high-frequency tube wave generator that is hydraulically coupled to the wellbore and is configured to generate high-frequency tube waves that propagate within the fluid column, wherein the high-frequency tube waves comprise a selected waveform containing a specific bandwidth of high-frequency components, and wherein the specific bandwidth of high-frequency components comprises at least 10% of frequencies above 1,000 Hertz (Hz); and a receiver that is hydraulically coupled to the wellbore and is configured to record data corresponding to the generated high-frequency tube waves and reflected high-frequency tube waves propagating within the fluid column, wherein the data relate to characteristics of the wellbore.

2. The hydrocarbon well of claim 1, wherein the characteristics of the wellbore comprise characteristics relating to reflectors within the wellbore, and wherein the reflectors comprise acoustic impedance boundaries arising from changes in cross-sectional area within the wellbore or changes in acoustic wave speeds of the high-frequency tube waves propagating within the fluid column.

3. The hydrocarbon well of claim 2, wherein the reflectors comprise at least one of one or more casing joints, one or more liner hangers, one or more valves, one or more plugs, one or more sand bridges, or fractures corresponding to one or more perforation clusters within a particular stage of the hydrocarbon well.

4. The hydrocarbon well of claim 1, wherein the high-frequency tube wave generator is configured to generate the high-frequency tube waves when the fluid column within the wellbore is static.

5. The hydrocarbon well of claim 1, wherein the fluid column comprises fracturing fluid that is present within the wellbore during a hydraulic fracturing process, and wherein the production casing string comprises a plurality of stages that are created during the hydraulic fracturing process, and wherein each of the plurality of stages comprises perforation clusters and corresponding fractures extending into the reservoir.

6. The hydrocarbon well of claim 5, wherein the high-frequency tube wave generator is configured to generate the high-frequency tube waves after each of the plurality of stages is hydraulically fractured, and wherein the data recorded by the receiver relate to characteristics of the fractures corresponding to the perforation clusters within each of the plurality of stages.

7. The hydrocarbon well of claim 6, wherein the characteristics of the fractures corresponding to the perforation clusters comprise at least one of a number of perforation clusters for which fractures have formed, sizes of the fractures corresponding to the perforation clusters for which the fractures have formed, locations of the perforation clusters for which the fractures have formed, or a number of perforation clusters that have been stimulated to at least a threshold level as measured by the characteristics of the fractures corresponding to the perforation clusters.

8. The hydrocarbon well of claim 6, wherein the high-frequency tube wave generator is further configured to generate the high-frequency tube waves before each of the plurality of stages is hydraulically fractured, and wherein the data recorded by the receiver forms a baseline pressure response for each of the plurality of stages.

9. The hydrocarbon well of claim 5, wherein at least one of the high-frequency tube wave generator and the receiver are positioned within the wellbore in proximity to the perforation clusters.

10. The hydrocarbon well of claim 1, wherein the receiver and the high-frequency tube wave generator are located at a predetermined minimum distance from each other to prevent interference between the generated high-frequency tubes and the reflected high-frequency tube waves propagating within the fluid column.

11. The hydrocarbon well of claim 1, wherein at least one of the high-frequency tube wave generator or the receiver is connected directly to the wellhead via one or more tubings.

12. The hydrocarbon well of claim 1, wherein at least one of the high-frequency tube wave generator or the receiver is located at one or more locations within the wellbore.

13. The hydrocarbon well of claim 1, wherein the high-frequency tube wave generator comprises at least one high-speed, actuated valve that is electrically or hydraulically controlled.

14. The hydrocarbon well of claim 13, wherein the at least one high-speed, actuated valve is configured to generate the high-frequency tube waves by:

opening and closing in a highly-controllable, highly-repeatable manner to allow a portion of a fluid within the fluid column to bleed off to open air or a storage container; or opening and closing in a highly-controllable, highly-repeatable manner to inject a fluid into the fluid column within the wellbore.

15. The hydrocarbon well of claim 13, wherein the at least one high-speed, actuated valve comprises two or more high-speed, actuated valves connected in parallel or in series, and wherein the two or more high-speed, actuated valves are electrically synchronized to open and close in a predetermined sequence and with a predetermined number of cycles to generate the high-frequency tube waves with the selected waveform.

16. The hydrocarbon well of claim 1, wherein the high-frequency tube wave generator comprises one or more rupture disks coupled with one or more corresponding valves, and wherein the one or more rupture disks and the one or more corresponding valves are configured to generate the high-frequency tube waves via failure of the one or more rupture disks and quick closure of the one or more corresponding valves in a highly-controllable, highly-repeatable manner to allow a portion of a fluid within the fluid column to bleed off to open air or a storage container.

17. The hydrocarbon well of claim 1, wherein the high-frequency tube wave generator comprises a fast-acting valve and a pipe that is hydraulically connected to the wellhead via the fast-acting valve, and wherein the fast-acting valve and the pipe are configured to generate the high-frequency tube waves via opening of the fast-acting valve to allow pressurized fluid within fluid column to oscillate between an entrance and a tip of the short pipe.

18. The hydrocarbon well of claim 1, wherein the high-frequency tube wave generator comprises a piezoelectric crystal-based source that is deployed within the production casing string and is configured to generate high-frequency tube waves with narrow frequency components.

19. The hydrocarbon well of claim 1, wherein the high-frequency tube wave generator comprises an explosive shock pulse generator.

20. The hydrocarbon well of claim 1, wherein the specific bandwidth of high-frequency components comprises an upper frequency limit that is selected based on an expected attenuation of the high-frequency tube waves and a minimum wavelength that can be tolerated for the high-frequency tube waves.

* * * * *